US010706986B2

(12) United States Patent
Kusakari et al.

(10) Patent No.: US 10,706,986 B2
(45) **Date of Patent: *Jul. 7, 2020**

(54) ALUMINUM ALLOY WIRE, ALUMINUM ALLOY STRAND WIRE, COVERED ELECTRICAL WIRE, AND TERMINAL-EQUIPPED ELECTRICAL WIRE

(71) Applicants: Sumitomo Electric Industries, Ltd., Osaka-shi (JP); AutoNetworks Technologies, Ltd., Yokkaichi (JP); Sumitomo Wiring Systems, Ltd., Yokkaichi (JP)

(72) Inventors: Misato Kusakari, Osaka (JP); Tetsuya Kuwabara, Osaka (JP); Yoshihiro Nakai, Osaka (JP); Taichiro Nishikawa, Osaka (JP); Yasuyuki Otsuka, Yokkaichi (JP); Hayato Ooi, Yokkaichi (JP)

(73) Assignees: Sumitomo Electric Industries, Ltd., Osaka-shi (JP); AutoNetworks Technologies, Ltd., Yokkaichi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/674,015

(22) Filed: Nov. 5, 2019

(65) Prior Publication Data

US 2020/0075191 A1 Mar. 5, 2020

Related U.S. Application Data

(63) Continuation of application No. 16/346,308, filed as application No. PCT/JP2017/030732 on Aug. 28, 2017, now Pat. No. 10,553,328.

(30) Foreign Application Priority Data

Oct. 31, 2016 (JP) ..... 2016-213157
Apr. 4, 2017 (JP) ..... 2017-074232

(51) Int. Cl.
*B21C 1/02* (2006.01)
*B21C 9/00* (2006.01)
(Continued)

(52) U.S. Cl.
CPC ..... *H01B 1/023* (2013.01); *B21C 1/003* (2013.01); *B21C 1/02* (2013.01); *B21C 9/00* (2013.01);
(Continued)

(58) Field of Classification Search
CPC . H01B 1/023; H01B 1/02; H01B 7/02; H01B 13/0016; H01B 13/0207;
(Continued)

(56) References Cited

U.S. PATENT DOCUMENTS 7,550,675 B2 * 6/2009 Susai ..... C22C 21/00 174/110 R
2003/0165387 A1 * 9/2003 Taylor ..... F04F 5/02 417/53
(Continued)

FOREIGN PATENT DOCUMENTS

JP 2010-067591 A 3/2010

*Primary Examiner* — Timothy J Thompson
*Assistant Examiner* — Michael F McAllister
(74) *Attorney, Agent, or Firm* — Baker Botts L.L.P.; Michael A. Sartori

(57) ABSTRACT

An aluminum alloy wire is composed of an aluminum alloy. The aluminum alloy contains equal to or more than 0.005 mass % and equal to or less than 2.2 mass % of Fe, and a remainder of Al and an inevitable impurity. In a transverse section of the aluminum alloy wire, a surface-layer crystal-
(Continued)

lization measurement region in a shape of a rectangle having a short side length of 50 μm and a long side length of 75 μm is defined within a surface layer region extending from a surface of the aluminum alloy wire by 50 μm in a depth direction, and an average area of crystallized materials in the surface-layer crystallization measurement region is equal to or more than 0.05 $\mu m^2$ and equal to or less than 3 $\mu m^2$.

17 Claims, 3 Drawing Sheets

(51) Int. Cl.

| | |
|---|---|
| ***B21F 7/00*** | (2006.01) |
| ***C22C 21/00*** | (2006.01) |
| ***C22F 1/04*** | (2006.01) |
| ***H01B 1/02*** | (2006.01) |
| ***H01B 7/02*** | (2006.01) |
| ***C22F 1/00*** | (2006.01) |
| ***H01B 13/14*** | (2006.01) |
| ***B21C 1/00*** | (2006.01) |
| ***B21C 37/04*** | (2006.01) |
| *H01B 13/00* | (2006.01) |
| *H01B 13/02* | (2006.01) |

(52) U.S. Cl.
CPC ..... *B21C 37/047* (2013.01); *B21F 7/00* (2013.01); *C22C 21/00* (2013.01); *C22F 1/04* (2013.01); *H01B 1/02* (2013.01); *H01B 7/02* (2013.01); *C22F 1/00* (2013.01); *H01B 13/0016* (2013.01); *H01B 13/0207* (2013.01); *H01B 13/14* (2013.01)

(58) Field of Classification Search
CPC ..... H01B 13/14; B21C 1/003; B21C 1/02; B21C 9/00; B21C 37/047; B21F 7/00; C22C 21/00; C22F 1/04; C22F 1/00
USPC ..... 174/74 R
See application file for complete search history.

(56) References Cited

U.S. PATENT DOCUMENTS

2013/0126055 A1* 5/2013 Sekiya ..... B21C 1/003 148/550
2014/0020796 A1* 1/2014 Sekiya ..... C22C 21/16 148/550
2017/0356073 A1* 12/2017 Sawa ..... C22C 21/16

* cited by examiner

ALUMINUM ALLOY WIRE, ALUMINUM ALLOY STRAND WIRE, COVERED ELECTRICAL WIRE, AND TERMINAL-EQUIPPED ELECTRICAL WIRE

TECHNICAL FIELD

The present invention relates to an aluminum alloy wire, an aluminum alloy strand wire, a covered electrical wire, and a terminal-equipped electrical wire.

The present application claims priority based on Japanese Patent Application No. 2016-213157 filed on Oct. 31, 2016 and priority based on Japanese Patent Application No. 2017-074232 filed on Apr. 4, 2017, and incorporates the entire description in the Japanese applications.

BACKGROUND ART

As a wire member suitable to a conductor for an electrical wire, PTL 1 discloses an aluminum alloy wire that contains an aluminum alloy as a specific composition and that is softened so as to have high strength, high toughness and high electrical conductivity and also to have excellent performance of fixation to a terminal portion.

CITATION LIST

Patent Literature

PTL 1: Japanese Patent Laying-Open No. 2010-067591

SUMMARY OF INVENTION

An aluminum alloy wire of the present disclosure is an aluminum alloy wire composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a surface-layer crystallization measurement region in a shape of a rectangle having a short side length of 50 μm and a long side length of 75 μm is defined within a surface layer region extending from a surface of the aluminum alloy wire by 50 μm in a depth direction, and an average area of crystallized materials in the surface-layer crystallization measurement region is equal to or more than 0.05 $\mu m^2$ and equal to or less than 3 $\mu m^2$.

An aluminum alloy strand wire of the present disclosure includes a plurality of the aluminum alloy wires of the present disclosure, the plurality of the aluminum alloy wires being stranded together.

A covered electrical wire of the present disclosure includes: a conductor; and an insulation cover that covers an outer circumference of the conductor.

The conductor includes the aluminum alloy strand wire of the present disclosure.

A terminal-equipped electrical wire of the present disclosure includes: the covered electrical wire of the present disclosure; and a terminal portion attached to an end portion of the covered electrical wire.

BRIEF DESCRIPTION OF DRAWINGS

FIG. 3 is an explanatory diagram illustrating a method of measuring a crystallized material, and the like.

FIG. 4 is another explanatory diagram illustrating the method of measuring a crystallized material, and the like.

DETAILED DESCRIPTION

Figure 1:
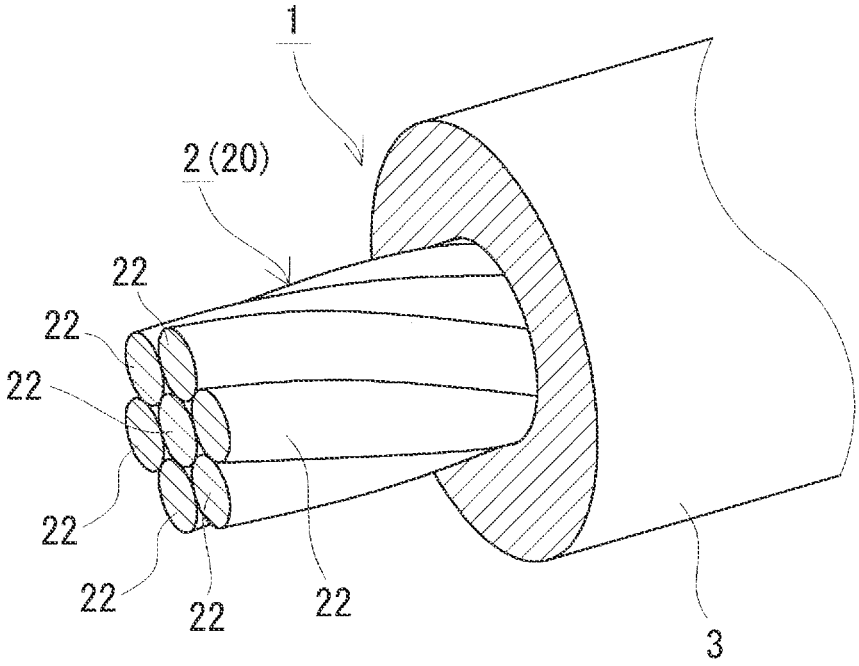
FIG. 1 is a schematic perspective view showing a covered electrical wire having a conductor including an aluminum alloy wire in an embodiment.

Problem to be Solved by the Present Disclosure

An aluminum alloy wire excellent in impact resistance and also excellent in fatigue characteristics is desired as a wire member utilized for a conductor or the like included in an electrical wire.

There are electrical wires for various uses such as wire harnesses placed in devices in an automobile, an airplane and the like, interconnections in various kinds of electrical devices such as an industrial robot, and interconnections in a building and the like. Such electrical wires may undergo an impact, repeated bending and the like during use, installation or the like of devices. The following are specific examples (1) to (3).

(1) It is conceivable that an electrical wire included in a wire harness for an automobile undergoes: an impact in the vicinity of a terminal portion, for example, during installation of an electrical wire to a subject to be connected (PTL 1); a sudden impact in accordance with the traveling state of an automobile; repeated bending by vibrations during traveling of an automobile; and the like.

(2) It is conceivable that an electrical wire routed in an industrial robot undergoes repeated bending, twisting or the like.

(3) It is conceivable that an electrical wire routed in a building undergoes: an impact due to sudden strong pulling or erroneous dropping by an operator during installation; repeated bending due to shaking in a wavelike motion for removing a curl from the wire member that has been wound in a coil shape; and the like.

Thus, it is desirable that the aluminum alloy wire used for a conductor and the like included in an electrical wire is less likely to be disconnected not only by an impact but also by repeated bending.

Accordingly, one object is to provide an aluminum alloy wire that is excellent in impact resistance and fatigue characteristics. Another object is to provide an aluminum alloy strand wire, a covered electrical wire and a terminal-equipped electrical wire that are excellent in impact resistance and fatigue characteristics.

Advantageous Effect of the Present Disclosure

The aluminum alloy wire of the present disclosure, the aluminum alloy strand wire of the present disclosure, the covered electrical wire of the present disclosure, and the terminal-equipped electrical wire of the present disclosure are excellent in impact resistance and fatigue characteristics.

Description of Embodiments

The present inventors have manufactured aluminum alloy wires under various conditions and conducted a study about an aluminum alloy wire that is excellent in impact resistance and fatigue characteristics (less likely to be disconnected against repeated bending). The wire member that is made of an aluminum alloy having a specific composition containing Fe in a specific range and that is subjected to softening treatment has high strength (for example, high tensile strength and high 0.2% proof stress), high toughness (for example, high breaking elongation), excellent impact resistance, and also, high electrical conductivity so as to be excellent in electrical conductive property. The present inventors have found that such a wire member is excellent in impact resistance and also less likely to be disconnected by repeated bending if the surface layer of this wire member contains fine crystallized materials. The present inventors also have found that the aluminum alloy wire having a surface layer containing fine crystallized materials can be manufactured, for example, by controlling the cooling rate in a specific temperature range to fall within a specific range in the casting process. The invention of the present application is based on the above-mentioned findings. The details of embodiments of the invention of the present application will be first listed as below for explanation.

(1) An aluminum alloy wire according to one aspect of the invention of the present application is an aluminum alloy wire composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a surface-layer crystallization measurement region in a shape of a rectangle having a short side length of 50 μm and a long side length of 75 μm is defined within a surface layer region extending from a surface of the aluminum alloy wire by 50 μm in a depth direction, and an average area of crystallized materials in the surface-layer crystallization measurement region is equal to or more than 0.05 $\mu m^2$ and equal to or less than 3 $\mu m^2$.

The transverse section of the aluminum alloy wire means a cross section cut along a plane orthogonal to the axis direction (the longitudinal direction) of the aluminum alloy wire.

The crystallized material is representatively a compound containing Fe and the like as an additive element and Al, and herein means a material having an area equal to or more than 0.05 $\mu m^2$ in the transverse section of the aluminum alloy wire (having an equivalent circle diameter of equal to or more than 0.25 $\mu m^2$ in the same area). A finer compound of the above-mentioned compounds having an area of less than 0.05 $\mu m^2$, representatively, having an equivalent circle diameter of equal to or less than 0.2 $\mu m^2$, furthermore, equal to or less than 0.15 $\mu m^2$ is referred to as a precipitate.

The above-mentioned aluminum alloy wire (which may be hereinafter referred to as an Al alloy wire) is formed of an aluminum alloy (which may be hereinafter referred to as an Al alloy) having a specific composition. The above-mentioned aluminum alloy wire is subjected to softening treatment or the like in the manufacturing process, so that it has high strength and high toughness and is also excellent in impact resistance. Due to high strength and high toughness, the above-mentioned aluminum alloy wire can be smoothly bent, is less likely to be disconnected even upon repeated bending, and also, is excellent in fatigue characteristics. Particularly, the above-mentioned Al alloy wire has a surface layer including fine crystallized materials. Accordingly, even upon an impact, repeated bending or the like, a coarse crystallized material is less likely to become origins of cracking, so that surface cracking is less likely to occur. Furthermore, progress of cracking through a coarse crystallized material is readily suppressed, so that progress of cracking from the surface of the wire member toward the inside thereof and breakage of the wire member can be reduced. Thus, the above-mentioned Al alloy wire is excellent in impact resistance and fatigue characteristics. Furthermore, the above-mentioned Al alloy wire includes crystallized materials that are finely grained but are sized to a certain extent, which may contribute to suppression of crystal grain growth in an Al alloy. Also due to fine crystal grains, improvement in impact resistance and fatigue characteristics can be expected. Furthermore, the above-mentioned Al alloy wire is less likely to undergo cracking resulting from a crystallized material. Accordingly, depending on the composition, the heat treatment conditions and the like, at least one selected from tensile strength, 0.2% proof stress and breaking elongation tends to be relatively higher than others in the tensile test, thereby also leading to excellent mechanical characteristics.

(2) An example of the above-mentioned Al alloy wire includes an embodiment in which the number of the crystallized materials existing in the surface-layer crystallization measurement region is more than 10 and equal to or less than 400.

According to the above-mentioned embodiment, the number of the above-mentioned fine crystallized materials existing in the surface layer of the Al alloy wire falls within the above-mentioned specific range, so that the crystallized materials are less likely to become origins of cracking while progress of cracking resulting from the crystallized materials is more likely to be suppressed, thereby leading to excellent impact resistance and fatigue characteristics.

(3) An example of the above-mentioned Al alloy wire includes an embodiment in which, in the transverse section of the aluminum alloy wire, an inside crystallization measurement region in a shape of a rectangle having a short side length of 50 μm and a long side length of 75 μm is defined such that a center of the rectangle of the inside crystallization measurement region coincides with a center of the aluminum alloy wire, and an average area of crystallized materials in the inside crystallization measurement region is equal to or more than 0.05 $\mu m^2$ and equal to or less than 40 $\mu m^2$.

According to the above-mentioned embodiment, the crystallized materials existing inside the Al alloy wire are also finely grained, so that breakage resulting from the crystallized materials is more likely to be suppressed, thereby leading to excellent impact resistance and fatigue characteristics.

(4) An example of the above-mentioned Al alloy wire includes an embodiment in which an average crystal grain size of the above-mentioned aluminum alloy is equal to or less than 50 μm.

According to the above-mentioned embodiment, the crystallized material is finely grained, and additionally, a crystal grain is finely grained, which allows excellent flexibility, thereby leading to more excellent impact resistance and fatigue characteristics.

(5) An example of the above-mentioned Al alloy wire includes an embodiment in which, in a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$.

According to the above-mentioned embodiment, the surface layer of the Al alloy wire includes finely grained crystallized materials and additionally a small amount of voids. Thus, even upon an impact or repeated bending, voids are less likely to become origins of cracking, so that cracking and progress of cracking that result from voids are readily suppressed. Accordingly, the above-mentioned Al alloy wire is more excellent impact resistance and fatigue characteristics.

(6) An example of the Al alloy wire in the above (5) including voids in a content in a specific range includes an embodiment in which, in the transverse section of the aluminum alloy wire, an inside void measurement region in a shape of a rectangle having a short side length of 30 μm and a long side length of 50 μm is defined such that a center of the rectangle of the inside void measurement region coincides with a center of the aluminum alloy wire, and a ratio of a total cross-sectional area of voids in the inside void measurement region to the total cross-sectional area of the voids in the surface-layer void measurement region is equal to or more than 1.1 and equal to or less than 44.

In the above-mentioned embodiment, the above-mentioned ratio of the total cross-sectional areas is equal to or more than 1.1. Thus, although the amount of voids inside the Al alloy wire is larger than that in the surface layer of the Al alloy wire, the above-mentioned ratio of the total cross-sectional areas falls within a specific range. Accordingly, it can be said that the amount of voids inside the Al alloy wire is also small. Therefore, in the above-mentioned embodiment, even upon an impact, repeated bending or the like, cracking is less likely to progress from the surface of the wire member toward the inside thereof through voids and less likely to be broken, thereby leading to more excellent impact resistance and fatigue characteristics.

(7) An example of the Al alloy wire in the above (5) or (6) including voids in a content in a specific range includes an embodiment in which a content of hydrogen is equal to or less than 4.0 ml/100 g.

The present inventors have examined the gas component contained in the Al alloy wire containing voids and have found that hydrogen is contained. Thus, one factor of voids occurring inside the Al alloy wire is considered as hydrogen. In the above-mentioned embodiment, the content of hydrogen is small, so that the amount of voids is also considered as being small. Accordingly, disconnection resulting from voids is less likely to occur, thereby leading to more excellent impact resistance and fatigue characteristics.

(8) An example of the above-mentioned Al alloy wire includes an embodiment in which a work hardening exponent is equal to or more than 0.05.

In the above-mentioned embodiment, the work hardening exponent falls within a specific range. Thus, when a terminal portion is attached by pressure bonding or the like, it can be expected that the fixing force of the terminal portion by work hardening is improved. Accordingly, the above-mentioned embodiment can be suitably utilized for a conductor to which a terminal portion is attached, such as a terminal-equipped electrical wire.

(9) An example of the above-mentioned Al alloy wire includes an embodiment in which a dynamic friction coefficient is equal to or less than 0.8.

By forming a strand wire, for example, using the Al alloy wire in the above-mentioned embodiment, elemental wires are more likely to slide on each other upon bending or the like, so that these elemental wires can be smoothly moved. Thus, each elemental wire is less likely to be disconnected. Accordingly, the above-mentioned embodiment is more excellent in fatigue characteristics.

(10) An example of the above-mentioned Al alloy wire includes an embodiment in which a surface roughness is equal to or less than 3 μm.

According to the above-mentioned embodiment, the surface roughness is relatively small, so that the dynamic friction coefficient is more likely to be reduced, thereby leading to particularly more excellent fatigue characteristics.

(11) An example of the above-mentioned Al alloy wire includes an embodiment in which a lubricant adheres to a surface of the aluminum alloy wire, and an amount of adhesion of C originated from the lubricant is more than 0 mass % and equal to or less than 30 mass %.

In the above-mentioned embodiment, it is considered that the lubricant adhering to the surface of the Al alloy wire is a remnant of the lubricant used in wire drawing or wire stranding during the manufacturing process. Since such a lubricant representatively includes carbon (C), the amount of adhesion of the lubricant is expressed by an amount of adhesion of C. In the above-mentioned embodiment, due to the lubricant existing on the surface of the Al alloy wire, the dynamic friction coefficient can be expected to be reduced, thereby resulting in more excellent fatigue characteristics. Moreover, in the above-mentioned embodiment, corrosion resistance is excellent due to the lubricant. Moreover, in the above-mentioned embodiment, since the amount of the lubricant (amount of C) on the surface of the Al alloy wire falls within a specific range, the amount of the lubricant (amount of C) is small between the Al alloy wire and a terminal portion when the terminal portion is attached. Thereby, connection resistance can be prevented from being increased due to an excessive amount of the lubricant therebetween. Therefore, the above-mentioned embodiment can be suitably utilized for a conductor to which a terminal portion is attached, such as a terminal-equipped electrical wire. In this case, a connection structure having particularly excellent fatigue characteristics, lower resistance and excellent corrosion resistance can be constructed.

(12) An example of the above-mentioned Al alloy wire includes an embodiment in which the aluminum alloy wire has a surface oxide film having a thickness of equal to or more than 1 nm and equal to or less than 120 nm.

In the above-mentioned embodiment, the thickness of the surface oxide film falls within a specific range. Accordingly, when a terminal portion is attached, the amount of oxide (that forms a surface oxide film) interposed between the terminal portion and the surface is small. Thus, the connection resistance can be prevented from increasing due to interposition of an excessive amount of oxide while excellent corrosion resistance can also be achieved. Accordingly, the above-mentioned embodiment can be suitably utilized for a conductor to which a terminal portion is attached, such as a terminal-equipped electrical wire. In this case, it becomes possible to implement a connection structure that is excellent in impact resistance and fatigue characteristics and also less resistant and excellent in corrosion resistance.

(13) An example of the above-mentioned Al alloy wire includes an embodiment in which tensile strength is equal to or more than 110 MPa and equal to or less than 200 MPa, 0.2% proof stress is equal to or more than 40 MPa, breaking elongation is equal to or more than 10%, and electrical conductivity is equal to or more than 55% IACS.

According to the above-mentioned embodiment, each of the tensile strength, the 0.2% proof stress and the breaking elongation is high, the mechanical characteristics are excellent, the impact resistance and the fatigue characteristics are more excellent, and also, the electrical characteristics are also excellent due to high electrical conductivity. Since the 0.2% proof stress is high, the above-mentioned embodiment shows excellent performance of fixation to a terminal portion.

(14) An aluminum alloy strand wire according to one aspect of the invention of the present application includes a plurality of the aluminum alloy wires described in any one of the above (1) to (13), the aluminum alloy wires being stranded together.

Each of elemental wires forming the above-mentioned aluminum alloy strand wire (which may be hereinafter referred to as an Al alloy strand wire) is formed of an Al alloy having a specific composition as described above and has a surface layer including a fine crystallized material, thereby leading to excellent impact resistance and fatigue characteristics. Furthermore, a strand wire is generally excellent in flexibility as compared with a solid wire having the same conductor cross-sectional area, and each of elemental wires thereof is less likely to be broken even upon an impact or repeated bending, thereby leading to excellent impact resistance and fatigue characteristics. In view of the above-described points, the above-mentioned Al alloy strand wire is excellent in impact resistance and fatigue characteristics. Each elemental wire is excellent in mechanical characteristics as described above. Accordingly, the above-mentioned Al alloy strand wire shows a tendency that at least one selected from tensile strength, 0.2% proof stress and breaking elongation is higher than others, thereby also leading to excellent mechanical characteristics.

(15) An example of the above-mentioned Al alloy strand wire includes an embodiment in which a strand pitch is equal to or more than 10 times and equal to or less than 40 times as large as a pitch diameter of the aluminum alloy strand wire.

The pitch diameter refers to the diameter of a circle that connects the respective centers of all of the elemental wires included in each layer of the strand wire having a multilayer structure.

In the above-mentioned embodiment, the strand pitch falls within a specific range. Thus, the elemental wires are less likely to be twisted during bending or the like, so that breakage is less likely to occur. Also, the elemental wires are less likely to be separated from each other during attachment of a terminal portion, so that the terminal portion is readily attached. Accordingly, the above-mentioned embodiment is particularly excellent in fatigue characteristics and also can be suitably utilized for a conductor to which a terminal portion is attached, such as a terminal-equipped electrical wire.

(16) A covered electrical wire according to one aspect of the invention of the present application is a covered electrical wire including: a conductor; and an insulation cover that covers an outer circumference of the conductor. The conductor includes the aluminum alloy strand wire described in the above (14) or (15).

Since the above-mentioned covered electrical wire includes a conductor formed of the above-mentioned Al alloy strand wire that is excellent in impact resistance and fatigue characteristics, it is excellent in impact resistance and fatigue characteristics.

(17) A terminal-equipped electrical wire according to one aspect of the invention of the present application includes: the covered electrical wire described in the above (16); and a terminal portion attached to an end portion of the covered electrical wire.

The above-mentioned terminal-equipped electrical wire is composed of components including a covered electrical wire having a conductor formed of the Al alloy wire and the Al alloy strand wire that are excellent in impact resistance and fatigue characteristics, thereby leading to excellent impact resistance and fatigue characteristics.

[Details of Embodiment of the Invention of the Present Application]

In the following, the embodiments of the invention of the present application will be described in detail appropriately with reference to the accompanying drawings, in which the components having the same name will be designated by the same reference characters. In the following description, the content of each element is shown by mass %.

[Aluminum Alloy Wire]

(Summary)

An aluminum alloy wire (Al alloy wire) 22 in an embodiment is a wire member formed of an aluminum alloy (Al alloy), and representatively utilized for a conductor 2 and the like of an electrical wire (FIG. 1). In this case, Al alloy wire 22 is utilized in the state of: a solid wire; a strand wire (Al alloy strand wire 20 in the embodiment) formed by stranding a plurality of Al alloy wires 22 together; or a compressed strand wire (another example of Al alloy strand wire 20 in the embodiment) formed by compression-molding a strand wire into a prescribed shape. FIG. 1 illustrates Al alloy strand wire 20 formed by stranding seven Al alloy wires 22 together. Al alloy wire 22 in the embodiment has a specific composition in which an Al alloy contains Fe in a specific range, and also has a specific structure in which a certain amount of fine crystallized materials exists in the surface layer of Al alloy wire 22. Specifically, the Al alloy forming Al alloy wire 22 in the embodiment is an Al—Fe-based alloy containing: equal to or more than 0.005% and equal to or less than 2.2% of Fe, and a remainder of Al and an inevitable impurity. Furthermore, Al alloy wire 22 in the embodiment has a transverse section, in which the average area of crystallized materials existing in the following region (referred to as a surface-layer crystallization measurement region) that is defined within a surface layer region extending from the surface of Al alloy wire 22 by 50 μm in the depth direction is equal to or more than 0.05 $\mu m^2$ and equal to or less than 3 $\mu m^2$. The surface-layer crystallization measurement region is defined as a region in a shape of a rectangle having a short side length of 50 μm and a long side length of 75 μm. Al alloy wire 22 in the embodiment having the above-mentioned specific composition and having a specific structure is subjected to softening treatment or the like in the manufacturing process, so that it has high strength, high toughness and excellent impact resistance, and also can be reduced in breakage resulting from a coarse crystallized material, thereby leading to more excellent impact resistance and fatigue characteristics.

The following is a more detailed explanation. The details of the method of measuring each parameter such as the size of a crystallized material and the details of the above-described effects will be described in Test Example.

(Composition)

Al alloy wire 22 in the embodiment is formed of an Al alloy containing 0.005% or more of Fe. Thus, Al alloy wire 22 can be increased in strength without excessive reduction in electrical conductivity. The higher Fe content leads to a higher strength of an Al alloy. Furthermore, Al alloy wire 22 is formed of an Al alloy containing Fe in a range equal to or less than 2.2%, which is less likely to cause reduction in electrical conductivity and toughness resulting from Fe content. Thus, this Al alloy wire 22 has high electrical conductivity, high toughness and the like, is less likely to be disconnected during wire drawing, and is also excellent in manufacturability. In consideration of the balance among the strength, the toughness and the electrical conductivity, the content of Fe can be set to be equal to or more than 0.1% and equal to or less than 2.0%, and equal to or more than 0.3% and equal to or less than 2.0%, and further, equal to or more than 0.9% and equal to or less than 2.0%.

When the Al alloy forming Al alloy wire 22 in the embodiment contains the following additive elements preferably in specific ranges as described later in addition to Fe, the mechanical characteristics such as strength and toughness can be expected to be improved, thereby leading to more excellent impact resistance and fatigue characteristics. The additive elements may be one or more types of elements selected from Mg, Si, Cu, Mn, Ni, Zr, Ag, Cr, and Zn. In the cases of Mg, Mn, Ni, Zr, and Cr, the electrical conductivity is greatly decreased but a high strength improving effect is achieved. Particularly when Mg and Si are contained simultaneously, the strength can be further enhanced. In the case of Cu, the electrical conductivity is less decreased and the strength can be further improved. In the cases of Ag and Zn, the electrical conductivity is less decreased and the strength improving effect is achieved to some extent. Due to improvement in strength, even after heat treatment such as softening treatment is performed, high breaking elongation and the like can be achieved while keeping high tensile strength and the like, thereby also contributing to improvement in impact resistance and fatigue characteristics. The content of each of the listed elements is equal to or more than 0% and equal to or less than 0.5%. The total content of the listed elements is equal to or more than 0% and equal to or less than 1.0%. Particularly when the total content of the listed elements is equal to or more than 0.005% and equal to or less than 1.0%, the above-mentioned effects of improving strength, impact resistance and fatigue characteristics and the like can be readily achieved. The following is an example of the content of each element. In the above-mentioned range of the total content and the following range of the content of each element, the higher contents are more likely to enhance the strength while the lower contents are more likely to increase the electrical conductivity.

(Mg) More than 0% and equal to or less than 0.5%, equal to or more than 0.05% and less than 0.5%, equal to or more than 0.05% and equal to or less than 0.4%, and equal to or more than 0.1% and equal to or less than 0.4%.

(Si) More than 0% and equal to or less than 0.3%, equal to or more than 0.03% and less than 0.3%, and equal to or more than 0.05% and equal to or less than 0.2%.

(Cu) Equal to or more than 0.05% and equal to or less than 0.5%, and equal to or more than 0.05% and equal to or less than 0.4%.

(Mn, Ni, Zr, Ag, Cr, and Zn, which may be hereinafter collectively referred to as an element α) Equal to or more than 0.005% and equal to or less than 0.2% in total, and equal to or more than 0.005% and equal to or less than 0.15% in total.

When the result of analyzing the components in pure aluminum used as a raw material shows that the raw material contains Fe as impurities and additive elements such as Mg as described above, the additive amount of each of the elements may be adjusted such that each of the contents of these elements becomes equal to a desired amount. In other words, the content of each additive element such as Fe shows a total amount including elements contained in the aluminum ground metal used as a raw material, and does not necessarily mean an additive amount.

The Al alloy forming Al alloy wire 22 in the embodiment can contain at least one element of Ti and B in addition to Fe. Ti and B have an effect of achieving a finely-grained crystal of the Al alloy during casting. When the cast material having a fine crystal structure is used as a base material, the crystal grains are readily finely grained even though it is subjected to processing such as rolling and wire drawing or heat treatment including softening treatment after casting. As compared with the case of a coarse crystal structure, Al alloy wire 22 having a fine crystal structure is less likely to be broken upon an impact or repeated bending, thereby leading to excellent impact resistance and fatigue characteristics. The higher grain-refining effect is obtained in the order of: containing B alone, containing Ti alone, and containing both Ti and B. In the case where Ti is included in a content equal to or more than 0% and equal to or less than 0.05% and further equal to or more than 0.005% and equal to or less than 0.05%, and in the case where B is included in a content equal to or more than 0% and equal to or less than 0.005% and further equal to or more than 0.001% and equal to or less than 0.005%, the crystal grain-refining effect can be achieved while the electrical conductivity reduction resulting from containing of Ti and B can be suppressed. In consideration of the balance between the crystal grain-refining effect and the electrical conductivity, the content of Ti can be set to be equal to or more than 0.01% and equal to or less than 0.04% and further equal to or less than 0.03% while the content of B can be set to be equal to or more than 0.002% and equal to or less than 0.004%.

A specific example of the composition containing the above-described elements in addition to Fe will be described below.

(1) Containing: equal to or more than 0.01% and equal to or less than 2.2% of Fe; and equal to or more than 0.05% and equal to or less than 0.5% of Mg, with a remainder of Al and an inevitable impurity.

(2) Containing: equal to or more than 0.01% and equal to or less than 2.2% of Fe; equal to or more than 0.05% and equal to or less than 0.5% of Mg; and equal to or more than 0.03% and equal to or less than 0.3% of Si, with a remainder of Al and an inevitable impurity.

(3) Containing: equal to or more than 0.01% and equal to or less than 2.2% of Fe; equal to or more than 0.05% and equal to or less than 0.5% of Mg; and equal to or more than 0.005% and equal to or less than 0.2% in total of one or more of elements selected from Mn, Ni, Zr, Ag, Cr, and Zn, with a remainder of Al and an inevitable impurity.

(4) Containing: equal to or more than 0.1% and equal to or less than 2.2% of Fe; and equal to or more than 0.05% and equal to or less than 0.5% of Cu, with a remainder of Al and an inevitable impurity.

(5) At least one of elements containing: equal to or more than 0.1% and equal to or less than 2.2% of Fe; equal to or more than 0.05% and equal to or less than 0.5% of Cu; equal to or more than 0.05% and equal to or less than 0.5% of Mg; and equal to or more than 0.03% and equal to or less than 0.3% of Si, with a remainder of Al and an inevitable impurity.

(6) In one of the above-mentioned (1) to (5), containing at least one of elements of: equal to or more than 0.005% and equal to or less than 0.05% of Ti; and equal to or more than 0.001% and equal to or less than 0.005% of B.

(Structure)

Crystallized Material

Figure 3:
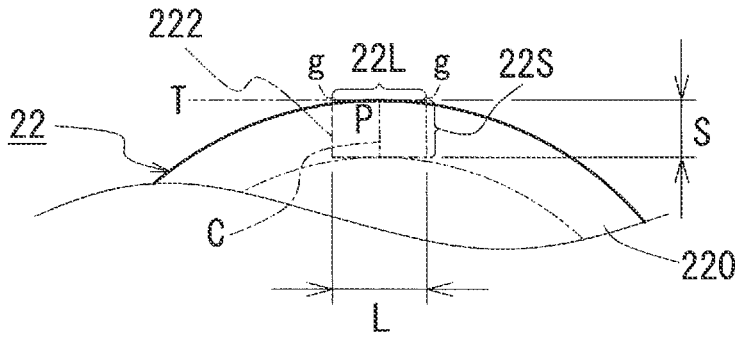

Al alloy wire 22 in the embodiment has a surface layer including a certain amount of fine crystallized materials. Specifically, in the transverse section of Al alloy wire 22, a surface layer region 220 extending from the surface of Al alloy wire 22 by 50 μm in the depth direction, that is, an annular region having a thickness of 50 μm, is defined as shown in FIG. 3. Then, within this surface layer region 220, a surface-layer crystallization measurement region 222 (indicated by a dashed line in FIG. 3) in a shape of a rectangle having a short side length S of 50 μm and a long side length L of 75 μm is defined. Short side length S corresponds to the thickness of surface layer region 220. Specifically, a tangent line T to an arbitrary point (a contact point P) on the surface of Al alloy wire 22 is defined. A straight line C having a length of 50 μm is defined in the direction normal to the surface from contact point P toward the inside of Al alloy wire 22. When Al alloy wire 22 is a round wire, straight line C extending toward the center of this circle of the round wire is defined. The straight line extending in parallel to straight line C and having a length of 50 μm is defined as a short side 22S. The straight line extending through contact point P along tangent line T and having a length of 75 μm so as to define contact point P as an intermediate point is defined as a long side 22L. Occurrence of a minute cavity (a hatched portion) g not including Al alloy wire 22 in surface-layer crystallization measurement region 222 is allowed. The average area of the crystallized materials existing in this surface-layer crystallization measurement region 222 is equal to or more than 0.05 $\mu m^2$ and equal to or less than 3 $\mu m^2$. Even when the surface layer contains a plurality of crystallized materials, the average size of these crystallized materials is equal to or less than 3 $\mu m^2$. Thus, cracking occurring from each crystallized material as an origin upon an impact or repeated bending is more likely to be suppressed, so that progress of cracking from the surface layer toward the inside thereof can also be suppressed. As a result, breakage resulting from crystallized materials can be suppressed. Thus, Al alloy wire 22 in the embodiment is excellent in impact resistance and fatigue characteristics. On the one hand, when the average area of the crystallized materials is large, coarse crystallized materials serving as origins of cracking are more likely to be included, thereby leading to inferior impact resistance and fatigue characteristics. On the other hand, since the average size of the crystallized materials is equal to or more than 0.05 $\mu m^2$, the following effects can be expected: reduction of decrease in electrical conductivity due to an added element, such as Fe, dissolved in a solid state; and suppression of crystal grain growth. As the above-mentioned average area is smaller, the cracking is more likely to be reduced. The average area is preferably equal to or less than 2.5 $\mu m^2$, equal to or less than 2 $\mu m^2$, and equal to or less than 1 $\mu m^2$. In order to cause a certain amount of crystallized materials to exist, the average area can be equal to or more than 0.08 $\mu m^2$ and equal to or less than 0.1 $\mu m^2$. The crystallized materials can be more likely to be reduced in size, for example, by reducing an added element such as Fe or increasing the cooling rate during casting. Particularly, by adjusting the cooling rate in the specific temperature range in the casting process, crystallized materials are allowed to appropriately exist (which will be described later in detail).

Figure 4:
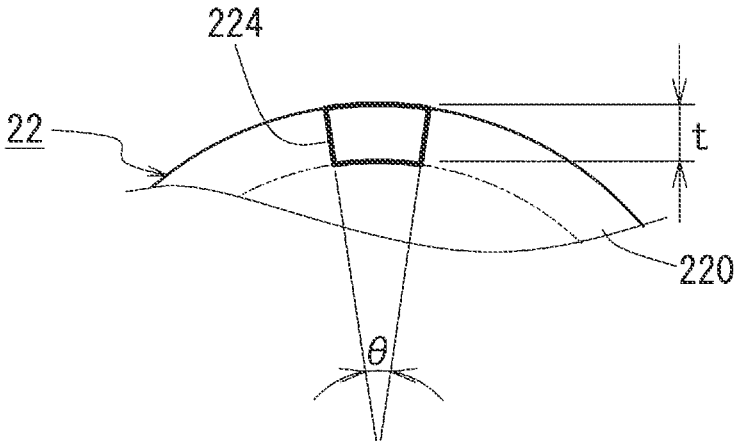

When Al alloy wire 22 is a round wire or when Al alloy wire 22 is substantially regarded as a round wire, the region for measurement of crystallized materials in the above-mentioned surface layer can be formed in a sector shape as shown in FIG. 4. FIG. 4 shows a crystallization measurement region 224 indicated by a bold line so as to be recognizable. As shown in FIG. 4, in the transverse section of Al alloy wire 22, surface layer region 220 extending from the surface of Al alloy wire 22 by 50 μm in the depth direction, that is, an annular region having a thickness t of 50 μm, is defined. From this surface layer region 220, a sector-shaped region (referred to as crystallization measurement region 224) having an area of 3750 $\mu m^2$ is defined. When a central angle θ of the sector-shaped region having an area of 3750 $\mu m^2$ is calculated using the area of annular surface layer region 220 and the area of 3750 $\mu m^2$ in crystallization measurement region 224, sector-shaped crystallization measurement region 224 can be extracted from annular surface layer region 220. If the average area of the crystallized materials existing in this sector-shaped crystallization measurement region 224 is equal to or more than 0.05 $\mu m^2$ and equal to or less than 3 $\mu m^2$, Al alloy wire 22 that is excellent in impact resistance and fatigue characteristics can be achieved for the reasons as described above. When both the rectangular-shaped surface-layer crystallization measurement region and the sector-shaped crystallization measurement region are defined and when the average area of crystallized materials existing in each of these regions is equal to or more than 0.05 $\mu m^2$ and equal to or less than 3 $\mu m^2$, it is expected that the reliability as a wire member excellent in impact resistance and fatigue characteristics can be enhanced.

In addition to the above-described specific sizes of the crystallized materials in the surface layer, it is preferable that, in at least one of the rectangular-shaped surface-layer crystallization measurement region and the sector-shaped crystallization measurement region, the number of the crystallized materials in the measurement region is more than 10 and equal to or less than 400. Since the number of the crystallized materials having the above-described specific sizes is not too large, i.e., equal to or less than 400, the crystallized materials are less likely to serve as origins of cracking and progress of cracking resulting from the crystallized materials is more likely to be reduced. Accordingly, this Al alloy wire 22 is excellent in impact resistance and fatigue characteristics. As the number of the crystallized materials is smaller, occurrence of cracking is likely to be more reduced. In view of this, the number of the crystallized materials is preferably equal to or less than 350, equal to or less than 300, equal to or less than 250, or equal to or less than 200. When there are more than 10 crystallized materials having the above-described specific sizes, the following effects can be expected as described above: suppression of decrease in electrical conductivity; suppression of crystal grain growth; and the like. In view of this, the number of the crystallized materials can be equal to or more than 15, or further, equal to or more than 20.

Further, when most of the crystallized materials in the surface layer have sizes of equal to or less than 3 $\mu m^2$, the crystallized materials are less likely to serve as origins of cracking due to those fine grain size, and dispersion strengthening provided by the crystallized materials having a uniform size can be expected. In view of this, in at least one of the rectangular-shaped surface-layer crystallization measurement region and the sector-shaped crystallization measurement region, a total area of crystallized materials each having an area of equal to or less than 3 $\mu m^2$ in the measurement region is preferably equal to or more than 50%, equal to or more than 60%, or equal to or more than 70% with respect to the total area of all the crystallized materials in the measurement region.

As one example, in Al alloy wire 22 of the embodiment, there are a certain amount of fine crystallized materials not only in the surface layer of Al alloy wire 22 but also in the inside of Al alloy wire 22. Specifically, in the transverse section of Al alloy wire 22, a region (referred to as "inside crystallization measurement region") in the shape of a rectangle having a short side length of 50 μm and a long side length of 75 μm is defined. This inside crystallization measurement region is defined such that the center of the rectangle coincides with the center of Al alloy wire 22. When Al alloy wire 22 is a shaped wire, the center of the inscribed circle is defined as the center of Al alloy wire 22 (the rest is the same as above). The average area of the crystallized materials in the inside crystallization measurement region is equal to or more than 0.05 $\mu m^2$ and equal to or less than 40 $\mu m^2$. Here, the crystallized materials are formed in the casting process and may be divided due to plastic working after casting, but the sizes thereof in the cast material are likely to be substantially maintained also in Al alloy wire 22 having the final wire diameter. In the casting process, solidification generally progresses from the surface layer of the metal toward the inside of the metal. Thus, the temperature inside the metal is likely to be maintained to be higher than the temperature of the surface layer of the metal for a long period of time. Accordingly, the crystallized materials existing inside the Al alloy wire 22 are likely to be larger than the crystallized materials in the surface layer. On the other hand, in Al alloy wire 22 of the above-mentioned embodiment, the crystallized materials existing inside Al alloy wire 22 are also fine. Thus, breakage resulting from the crystallized materials is more likely to be reduced, thereby leading to excellent impact resistance and fatigue characteristics. As with the above-described surface layer, in order to reduce breakage, a smaller average area is more preferable. The average area is equal to or less than 20 $\mu m^2$, equal to or less than 10 $\mu m^2$, particularly, equal to or less than 5 $\mu m^2$, or equal to or less than 2.5 $\mu m^2$. In order to cause a certain amount of crystallized materials to exist, the above-mentioned average area can be equal to or more than 0.08 $\mu m^2$ or equal to or more than 0.1 $\mu m^2$.

Crystal Grain Size

As an example of Al alloy wire 22 in the embodiment, there may be an Al alloy wire made of an Al alloy having an average crystal grain size equal to or less than 50 μm. Al alloy wire 22 having a fine crystal structure is more likely to undergo bending and the like, and is excellent in flexibility, so that this Al alloy wire 22 is less likely to be broken upon an impact or repeated bending. In Al alloy wire 22 in the embodiment, the crystallized materials are small in size and preferably voids are small in amount (described later) in the surface layer thereof, so that this Al alloy wire 22 is excellent in impact resistance and fatigue characteristics. The smaller average crystal grain size allows easier bending or the like, thereby leading to excellent impact resistance and fatigue characteristics. Thus, it is preferable that the average crystal grain size is equal to or less than 45 μm, equal to or less than 40 μm, and equal to or less than 30 μm. Depending on the composition or the manufacturing conditions, the crystal grain size is more likely to be finely grained, for example, when it contains Ti and B as described above.

Voids

As an example of Al alloy wire 22 in the embodiment, there may be an Al alloy wire having a surface layer including a small amount of voids. Specifically, in the transverse section of Al alloy wire 22, a region in a shape of rectangle having a short side length of 30 μm and a long side length of 50 mm (which will be referred to as a surface-layer void measurement region) is defined within a surface layer region from a surface of Al alloy wire 22 by 30 μm in the depth direction, that is, an annular region having a thickness of 30 μm. The short side length corresponds to the thickness of the surface layer region. The total cross-sectional area of the voids existing in this surface-layer void measurement region is equal to or less than 2 $\mu m^2$. In the case where Al alloy wire 22 is a round wire or can be substantially regarded as a round wire, in the transverse section of Al alloy wire 22, a sector-shaped region (referred as a void measurement region) having an area of 1500 $\mu m^2$ is defined within the above-mentioned annular region having a thickness of 30 μm, and the total cross-sectional area of the voids existing in this sector-shaped void measurement region is equal to or less than 2 $\mu m^2$. The rectangular surface-layer void measurement region and the sector-shaped void measurement region may be defined by changing short side length S to 30 μm, changing long side length L to 50 μm, changing thickness t to 30 μm, or changing the area to 1550 $\mu m^2$ in the same manner as in surface-layer crystallization measurement region 222 and sector-shaped crystallization measurement region 224 described above. When the rectangular surface-layer void measurement region and the sector-shaped void measurement region each are defined and the total area of voids existing in each of these regions is equal to or less than 2 $\mu m^2$, it is expected to increase the reliability as a wire member that is excellent in impact resistance and fatigue characteristics. When the surface layer contains a small amount of voids, cracking occurring from the voids as origins upon an impact or repeated bending is more likely to be suppressed, so that progress of cracking from the surface layer toward the inside thereof can also be suppressed. As a result, breakage resulting from voids can be suppressed. Thus, this Al alloy wire 22 is excellent in impact resistance and fatigue characteristics. On the one hand, when the total area of voids is relatively large, coarse voids exist or a large amount of fine voids exist. Thus, voids become origins of cracking or cracking is more likely to progress, thereby leading to inferior impact resistance and fatigue characteristics. On the other hand, the smaller total cross-sectional area of voids leads to a smaller amount of voids, to reduce breakage resulting from voids, thereby leading to excellent impact resistance and fatigue characteristics. Thus, the total cross-sectional area of voids is preferably less than 1.5 $\mu m^2$, equal to or less than 1 $\mu m^2$, and further, equal to or less than 0.95 $\mu m^2$, and more preferably closer to zero. For example, when the temperature of melt is set to be relatively low in the casting process, the amount of voids is more likely to be reduced. In addition, acceleration of the cooling rate during casting, particularly the cooling rate in a specific temperature range described later, tends to lead to a smaller amount and smaller size of voids.

As an example of Al alloy wire 22 in the embodiment, there may be an Al alloy wire in which the amount of voids is small not only in the surface layer but also inside thereof. Specifically, in the transverse section of Al alloy wire 22, a region in a shape of a rectangle having a short side length of 30 μm and a long side length of 50 μm (which will be referred to as an inside void measurement region) is defined. This inside void measurement region is defined such that the center of the rectangle coincides with the center of Al alloy wire 22. In at least one of the rectangular-shaped surface-layer void measurement region and the sector-shaped void measurement region, the ratio of a total cross-sectional area Sib of voids existing in the inside void measurement region to a total cross-sectional area Sfb of voids existing in the above-mentioned measurement region (Sib/Sfb) is equal to or more than 1.1 and equal to or less than 44. As described above, in the casting process, solidification progresses from the surface layer of metal toward the inside thereof. Accordingly, when the gas in the atmosphere dissolves in a melt, gas in the surface layer of metal is more likely to leak to the outside thereof, but gas inside the metal is more likely to be confined and remained therein. In the case of the wire member manufactured using such a cast material as a base material, it is considered that the amount of voids is more likely to be larger inside the metal than in the surface layer thereof. If total cross-sectional area Sfb of the voids in the surface layer is small as described above, the amount of voids existing inside the metal is also small in the embodiment in which the above-mentioned ratio Sib/Sfb is small. Accordingly, in the present embodiment, occurrence and progress of cracking occurring upon an impact or repeated bending are more likely to be reduced, so that breakage resulting from voids is suppressed, thereby leading to excellent impact resistance and fatigue characteristics. The smaller ratio Sib/Sfb leads to a smaller amount of inside voids, thereby leading to excellent impact resistance and fatigue characteristics. Thus, it is more preferable that the ratio Sib/Sfb is equal to or less than 40, equal to or less than 30, equal to or less than 20, and equal to or less than 15. It is considered that the above-mentioned ratio Sib/Sfb of equal to or more than 1.1 is suitable for mass production since it allows production of Al alloy wire 22 including a small amount of voids without having to set the temperature of melt to be excessively low. It is considered that mass production is facilitated when the above-mentioned ratio Sib/Sfb is about 1.3 to 6.0.

(Hydrogen Content)

As an example of Al alloy wire 22 in the embodiment, there may be an Al alloy wire containing 4.0 ml/100 g or less of hydrogen. One factor of causing voids is considered as hydrogen as described above. When the hydrogen content is 4.0 ml or less per 100 g in mass of Al alloy wire 22, this Al alloy wire 22 includes a small amount of voids, so that breakage resulting from voids can be suppressed as described above. It is considered that a smaller hydrogen content leads to a smaller amount of voids. Thus, the hydrogen content is preferably equal to or less than 3.8 ml/100 g, equal to or less than 3.6 ml/100 g, and equal to or less than 3 ml/100 g, and more preferably closer to zero. Hydrogen in Al alloy wire 22 is considered as a remnant of dissolved hydrogen that is produced by dissolution of water vapor in the atmosphere into a melt by casting in the atmosphere containing water vapor in air atmosphere or the like. Accordingly, the hydrogen content tends to be reduced, for example, when dissolution of the gas from atmosphere is reduced by setting the temperature of melt to be relatively low. Furthermore, the hydrogen content tends to be reduced when at least one of Cu and Si is contained.

(Surface Property)

Dynamic Friction Coefficient

As an example of Al alloy wire 22 in the embodiment, there may be an Al alloy wire having a dynamic friction coefficient of equal to or less than 0.8. When Al alloy wire 22 having such a small dynamic friction coefficient is used, for example, for an elemental wire of a strand wire and this strand wire is subjected to repeated bending, friction is small between the elemental wires (Al alloy wires 22), thereby allowing the elemental wires to slide on one another, with the result that each elemental wire can be moved smoothly. Here, when the dynamic friction coefficient is large, the friction between the elemental wires is large. Hence, when repeated bending is applied, each of the elemental wires is more likely to be broken due to this friction, with the result that the strand wire is more likely to be disconnected. Particularly when used for the strand wire, Al alloy wire 22 having a dynamic friction coefficient of equal to or less than 0.8 can reduce the friction between the elemental wires. Accordingly, each of the elemental wires is less likely to be disconnected even upon repeated bending, thus resulting in excellent fatigue characteristics. As the dynamic friction coefficient is smaller, breakage resulting from friction can be more reduced. The dynamic friction coefficient is preferably equal to or less than 0.7, equal to or less than 0.6, or equal to or less than 0.5. The dynamic friction coefficient is more likely to be small by providing a smooth surface of Al alloy wire 22, applying a lubricant onto the surface of Al alloy wire 22, or both.

Surface Roughness

As an example of Al alloy wire 22 in the embodiment, there may be an Al alloy wire having a surface roughness of equal to or less than 3 μm. In Al alloy wire 22 having such a small surface roughness, the dynamic friction coefficient tends to be small. When Al alloy wire 22 is used for an elemental wire of a strand wire as described above, friction between the elemental wires can be reduced, thus resulting in excellent fatigue characteristics. As the surface roughness is smaller, the dynamic friction coefficient is more likely to be smaller and the friction between the elemental wires can be readily reduced. Hence, the surface roughness is preferably equal to or less than 2.5 μm, equal to or less than 2 μm, or equal to or less than 1.8 μm. For example, the surface roughness is readily reduced by manufacturing Al alloy wire 22 to have a smooth surface in the following manner: a wire-drawing die having a surface roughness of equal to or less than 3 μm is used; a larger amount of lubricant is prepared for wire drawing; or the like. When the lower limit of the surface roughness is set to be 0.01 μm or to be 0.03 μm, it is expected to facilitate industrial mass-production of Al alloy wire 22.

C Amount

As an example of Al alloy wire 22 in the embodiment, there may be an Al alloy wire 22 having a surface to which a lubricant adheres, and an amount of adhesion of C originated from the lubricant is more than 0 mass % and equal to or less than 30 mass %. It is considered that the lubricant adhering to the surface of Al alloy wire 22 is a remaining lubricant (representatively, oil) used in the manufacturing process as described above. In Al alloy wire 22 in which the amount of adhesion of C falls within the above-mentioned range, the dynamic friction coefficient is likely to be small due to adhesion of the lubricant. The dynamic friction coefficient tends to be smaller as the amount of adhesion of C is larger in the above-mentioned range. Since the dynamic friction coefficient is small, friction between the elemental wires can be reduced when Al alloy wire 22 is used for an elemental wire of a strand wire as described above, thus resulting in excellent fatigue characteristics. Moreover, corrosion resistance is also excellent due to adhesion of the lubricant. As the amount of adhesion is smaller in the above-mentioned range, an amount of the lubricant interposed between conductor 2 and a terminal portion 4 (FIG. 2) can be reduced when terminal portion 4 is attached to an end portion of conductor 2 constituted of Al alloy wires 22. In this case, connection resistance between conductor 2 and terminal portion 4 can be prevented from being increased due to an excessive amount of the lubricant interposed therebetween. In consideration of the reduction of friction and the suppression of increase of connection resistance, the amount of adhesion of C can be set to be equal to or more than 0.5 mass % and equal to or less than 25 mass %, and further, equal to or more than 1 mass % and equal to or less than 20 mass %. In order to attain a desired amount of adhesion of C, it is conceivable to adjust the amount of the lubricant used during wire drawing or wire stranding or to adjust the heat treatment condition or the like, for example.

This is because the lubricant is reduced or removed depending on the heat treatment condition.

(Surface Oxide Film)

As an example of Al alloy wire 22 in the embodiment, there may be an Al alloy wire 22 having a surface oxide film that has a thickness of equal to or more than 1 nm and equal to or less than 120 nm. When the heat treatment such as softening treatment is performed, an oxide film may exist on the surface of Al alloy wire 22. When the surface oxide film is as thin as 120 nm or less, it becomes possible to reduce the amount of the oxide that is interposed between conductor 2 and terminal portion 4 when terminal portion 4 is attached to the end portion of conductor 2 formed of Al alloy wire 22. When the amount of oxide as an electrical insulator interposed between conductor 2 and terminal portion 4 is small, an increase in connection resistance between conductor 2 and terminal portion 4 can be suppressed. On the other hand, when the surface oxide film is equal to or more than 1 nm, the corrosion resistance of Al alloy wire 22 is increased. As the film is thinner in the above-mentioned range, the above-mentioned connection resistance increase can be more reduced. As the film is thicker in the above-mentioned range, the corrosion resistance can be more enhanced. In consideration of the suppression of the connection resistance increase and the corrosion resistance, the surface oxide film can be formed to have a thickness equal to or more than 2 nm and equal to or less than 115 nm, further, equal to or more than 5 nm and equal to or less than 110 nm, and still further equal to or less than 100 nm. The thickness of the surface oxide film can be adjusted, for example, by the heat treatment conditions. For example, the higher oxygen concentration in an atmosphere (for example, air atmosphere) is more likely to increase the thickness of the surface oxide film. The lower oxygen concentration (for example, inactive gas atmosphere, reducing gas atmosphere, and the like) is more likely to reduce the thickness of the surface oxide film.

(Characteristics)

Work Hardening Exponent

As an example of Al alloy wire 22 in the embodiment, there may be an Al alloy wire having a work hardening exponent equal to or more than 0.05. When the work hardening exponents is as high as 0.05 or more, Al alloy wire 22 is readily work-hardened in the case where plastic working is performed, for example, in which a strand wire formed by stranding a plurality of Al alloy wires 22 together is compression-molded into a compressed strand wire, and in which terminal portion 4 is pressure-bonded to the end portion of conductor 2 (which may be any one of a solid wire, a strand wire and a compressed strand wire) formed of Al alloy wires 22. Even when the cross-sectional area is decreased by plastic working such as compression molding and pressure bonding, strength is increased by work hardening and terminal portion 4 can be firmly fixed to conductor 2. Thus, Al alloy wire 22 having a large work hardening exponent allows formation of conductor 2 that is excellent in performance of fixation to terminal portion 4. It is preferable that the work hardening exponent is equal to or more than 0.08 and further equal to or more than 0.1 since the larger work hardening exponent can be expected to more improve the strength by work hardening. The work hardening exponent is more likely to be increased as the breaking elongation is larger. Thus, in order to increase the work hardening exponent, for example, the breaking elongation may be increased by adjusting the type, the content, the heat treatment conditions and the like of additive elements. In the case of Al alloy wire 22 having a specific structure in which the sizes of the crystallized materials fall within the above-mentioned specific range and the average crystal grain size falls within the above-mentioned specific range, the work hardening exponent is more likely to be equal to or more than 0.05. Thus, the work hardening exponent can be adjusted also by adjusting the type, the content, the heat treatment conditions and the like of additive elements using the structure of the Al alloy as an index.

Mechanical Characteristics and Electrical Characteristics

Al alloy wire 22 in the embodiment is formed of an Al alloy having the above-mentioned specific composition, and representatively subjected to heat treatment such as softening treatment, thereby leading to high tensile strength, high 0.2% proof stress, excellent strength, high breaking elongation, excellent toughness, high electrical conductivity, and also excellent electrical conductive property. Quantitatively, Al alloy wire 22 is assumed to satisfy one or more selected from the characteristics including: tensile strength equal to or more than 110 MPa and equal to or less than 200 MPa; 0.2% proof stress equal to or more than 40 MPa; breaking elongation equal to or more than 10%; and electrical conductivity equal to or more than 55% IACS. Al alloy wire 22 satisfying two characteristics, three characteristics and particularly all four characteristics among the above-mentioned characteristics is preferable since such Al alloy wire 22 is excellent in mechanical characteristics, more excellent in impact resistance and fatigue characteristics, excellent in impact resistance and fatigue characteristics, and excellent also in electrical conductive property. Such Al alloy wire 22 can be suitably utilized as a conductor of an electrical wire.

The higher tensile strength in the above-mentioned range leads to more excellent strength. The lower tensile strength in the above-mentioned range is more likely to increase the breaking elongation and the electrical conductivity. In view of the above, the above-mentioned tensile strength can be set to be equal to or more than 110 MPa and equal to or less than 180 MPa, and further, equal to or more than 115 MPa and equal to or less than 150 MPa.

The higher breaking elongation in the above-mentioned range leads to more excellent flexibility and toughness, thereby allowing easy bending and the like. Thus, the above-mentioned breaking elongation can be set to be equal to or more than 13%, equal to or more than 15%, and further, equal to or more than 20%.

Since Al alloy wire 22 is representatively utilized for conductor 2, the higher electrical conductivity is more preferable. Thus, it is more preferable that the electrical conductivity is equal to or more than 56% IACS, equal to or more than 57% IACS, and further, equal to or more than 58% IACS.

It is preferable that Al alloy wire 22 also has high 0.2% proof stress. This is because, in the case of the same tensile strength, the higher 0.2% proof stress is more likely to lead to excellent performance of fixation to terminal portion 4. The 0.2 proof stress can be set to be equal to or more than 45 MPa, equal to or more than 50 MPa, and further, equal to or more than 55 MPa.

When the ratio of the 0.2% proof stress to the tensile strength is equal to or more than 0.4, Al alloy wire 22 exhibits sufficiently high 0.2% proof stress, has high strength, is less likely to be broken, and also has excellent performance of fixation to terminal portion 4, as described above. It is preferable that this ratio is equal to or more than 0.42 and also equal to or more than 0.45 since the higher ratio leads to higher strength and more excellent performance of fixation to terminal portion 4.

The tensile strength, the 0.2% proof stress, the breaking elongation, and the electrical conductivity can be changed, for example, by adjusting the type, the content, the manufacturing conditions (wire-drawing conditions, heat treatment conditions and the like) of additive elements. For example, larger amounts of additive elements tend to lead to higher tensile strength and higher 0.2% proof stress. Smaller amounts of additive elements tend to lead to higher electrical conductivity. Also, a higher heating temperature during the heat treatment tends to lead to higher breaking elongation.

(Shape)

The shape of the transverse section of Al alloy wire 22 in the embodiment can be selected as appropriate depending on an intended use and the like. For example, there may be a round wire having a transverse section of a circular shape (see FIG. 1). In addition, there may be a rectangular wire or the like having a transverse section of a quadrangular shape such as a rectangular shape. When Al alloy wire 22 forms an elemental wire of the above-mentioned compressed strand wire, it representatively has a deformed shape having a crushed circle. As the above-mentioned measurement region for evaluating crystallized materials and voids, a rectangular region is easily utilized when Al alloy wire 22 is a rectangular wire and the like, and a rectangular region or a sector-shaped region may be utilized when Al alloy wire 22 is a round wire or the like. The shape of the wire-drawing die, the shape of the die for compression molding, and the like may be selected such that the shape of the transverse section of Al alloy wire 22 is formed in a desired shape.

(Dimensions)

The dimensions (the transverse sectional area, the wire diameter (diameter) in the case of a round wire, and the like) of Al alloy wire 22 in the embodiment can be selected as appropriate depending on an intended use and the like. For example, when Al alloy wire 22 is used for a conductor of an electrical wire provided in various kinds of wire harnesses such as a wire harness for an automobile, the wire diameter of Al alloy wire 22 may be equal to or more than 0.2 mm and equal to or less than 1.5 mm. For example, when Al alloy wire 22 is used for a conductor of an electrical wire for constructing the interconnection structure of a building and the like, the wire diameter of Al alloy wire 22 may be equal to or more than 0.2 mm and equal to or less than 3.6 mm.

[Al Alloy Strand Wire]

Al alloy wire 22 in the embodiment can be utilized for an elemental wire of a strand wire, as shown in FIG. 1. Al alloy strand wire 20 in the embodiment is formed by stranding a plurality of Al alloy wires 22 together. Al alloy strand wire 20 is formed by stranding a plurality of elemental wires (Al alloy wires 22) each having a cross-sectional area smaller than that of the Al alloy wire as a solid wire having the same conductor cross-sectional area, thereby leading to excellent flexibility and allowing easy bending and the like. Furthermore, since the wires are stranded together, the strand wire is entirely excellent in strength even though Al alloy wire 22 as each elemental wire is relatively thin. Furthermore, Al alloy strand wire 20 in the embodiment is formed using, as an elemental wire, Al alloy wire 22 having a specific structure including fine crystallized materials. In view of the above, even when Al alloy strand wire 20 undergoes an impact or repeated bending, Al alloy wire 22 as each elemental wire is less likely to be broken, thereby leading to excellent impact resistance and fatigue characteristics. When at least one of characteristics selected from the number of crystallized materials, the content of voids, the hydrogen content, the crystal grain size, the magnitude of the dynamic friction coefficient, the surface roughness, and the amount of adhesion of C as described above falls within the above-mentioned corresponding specific range, Al alloy wire 22 as each elemental wire is further excellent in impact resistance and fatigue characteristics. Particularly when the dynamic friction coefficient is small, the friction between the elemental wires is reduced as described above, thereby allowing formation of Al alloy strand wire 20 that is more excellent in fatigue characteristics.

The number of stranding wires for Al alloy strand wire 20 can be selected as appropriate, and may be 7, 11, 16, 19, 37 and the like, for example. The strand pitch of Al alloy strand wire 20 can be selected as appropriate. In this case, when the strand pitch is set to be equal to or more than 10 times as large as the pitch diameter of Al alloy strand wire 20, the wires are less likely to be separated when terminal portion 4 is attached to the end portion of conductor 2 formed of Al alloy strand wire 20, so that terminal portion 4 can be attached in an excellent workability. On the other hand, when the strand pitch is set to be equal to or less than 40 times as large as the above-mentioned pitch diameter, the elemental wires are less likely to be twisted upon bending or the like, so that breakage is less likely to occur, thereby leading to excellent fatigue characteristics. In consideration of preventing separation and twisting of wires, the strand pitch can be set to be equal to or more than 15 times and equal to or less than 35 times as large as the above-mentioned pitch diameter, and also, equal to or more than 20 times and equal to or less than 30 times as large as the above-mentioned pitch diameter.

Al alloy strand wire 20 can be formed as a compressed strand wire that has been further subjected to compression-molding. In this case, the wire diameter can be reduced more than that in the state where the wires are simply stranded together, or the outer shape can be formed in a desired shape (for example, a circle). When the work hardening exponent of Al alloy wire 22 as each elemental wire is relatively high as described above, the strength, the impact resistance and the fatigue characteristics can also be expected to be improved.

The specifications of each Al alloy wire 22 forming Al alloy strand wire 20 such as the composition, the structure, the surface oxide film thickness, the hydrogen content, the amount of adhesion of C, the surface property, the mechanical characteristics, and the electrical characteristics are substantially maintained at the specifications of Al alloy wire 22 used before wire stranding. Depending on the reasons such as using a lubricant during wire stranding or performing heat treatment after wire stranding, the thickness of the surface oxide film, the amount of adhesion of C, the mechanical characteristic, and the electrical characteristics may be changed. The stranding conditions may be adjusted such that the specifications of Al alloy strand wire 20 achieve desired values.

[Covered Electrical Wire]

Al alloy wire 22 in the embodiment and Al alloy strand wire 20 (which may be a compressed strand wire) in the embodiment can be suitably utilized for a conductor for an electrical wire, and also can be utilized for each of a bare conductor having no insulation cover and a conductor of a covered electrical wire having an insulation cover. Covered electrical wire 1 in the embodiment includes conductor 2 and insulation cover 3 that covers the outer circumference of conductor 2, and also includes, as conductor 2, Al alloy wire 22 in the embodiment or Al alloy strand wire 20 in the embodiment. This covered electrical wire 1 includes conductor 2 formed of Al alloy wire 22 and Al alloy strand wire 20 each of which is excellent in impact resistance and fatigue characteristics, thereby leading to excellent impact resistance and fatigue characteristics. The insulating material forming insulation cover 3 can be selected as appropriate. Examples of the above-mentioned insulating material may be materials excellent in flame resistance such as polyvinyl chloride (PVC), non-halogen resin, and the like, which can be known materials. The thickness of insulation cover 3 can be selected as appropriate in a range exhibiting prescribed insulation strength.

[Terminal-Equipped Electrical Wire]

Figure 2:
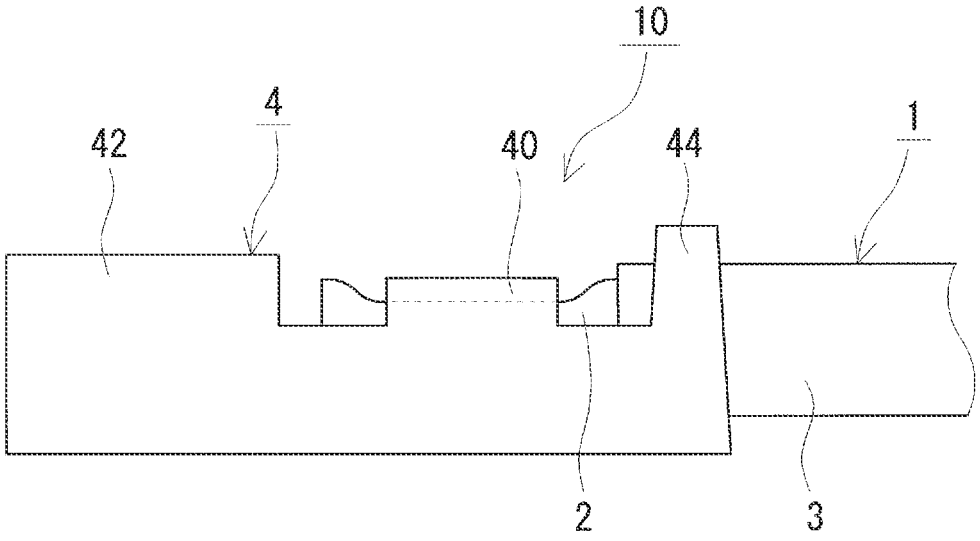
FIG. 2 is a schematic side view showing the vicinity of a terminal portion of a terminal-equipped electrical wire in an embodiment.

Covered electrical wire 1 in the embodiment can be utilized for electrical wires for various uses such as wire harnesses placed in devices in an automobile, an airplane and the like, interconnections in various kinds of electrical devices such as an industrial robot, interconnections in a building, and the like. When covered electrical wire 1 is provided in a wire harness or the like, representatively, terminal portion 4 is attached to the end portion of covered electrical wire 1. Terminal-equipped electrical wire 10 in the embodiment includes covered electrical wire 1 in the embodiment and terminal portion 4 attached to the end portion of covered electrical wire 1, as shown in FIG. 2. Since this terminal-equipped electrical wire 10 includes covered electrical wire 1 that is excellent in impact resistance and fatigue characteristics, it is also excellent in impact resistance and fatigue characteristics. FIG. 2 shows an example of a crimp terminal as terminal portion 4 having: one end including a female-type or male-type fitting portion 42; the other end including an insulation barrel portion 44 for gripping insulation cover 3; and an intermediate portion including a wire barrel portion 40 for gripping conductor 2. Another example of terminal portion 4 may be a melting-type terminal portion for melting conductor 2 for connection.

The crimp terminal is pressure-bonded to the end portion of conductor 2 exposed by removing insulation cover 3 at the end portion of covered electrical wire 1, and is electrically and mechanically connected to conductor 2. When Al alloy wire 22 and Al alloy strand wire 20 forming conductor 2 are relatively high in work hardening exponent as described above, the portion of conductor 2 to which the crimp terminal is attached has a cross-sectional area that is locally reduced, but has excellent strength due to work hardening. Thus, for example, even upon an impact during connection between terminal portion 4 and the connection subject of covered electrical wire 1, and even upon repeated bending after connection, breakage of conductor 2 in the vicinity of terminal portion 4 can be suppressed. Thus, this terminal-equipped electrical wire 10 is excellent in impact resistance and fatigue characteristics.

In Al alloy wire 22 and Al alloy strand wire 20 forming conductor 2, when the amount of adhesion of C is relatively small and the surface oxide film is thin as described above, an electrical insulator (a lubricant containing C, an oxide forming a surface oxide film, and the like) interposed between conductor 2 and terminal portion 4 can be reduced, so that the connection resistance between conductor 2 and terminal portion 4 can be reduced. Accordingly, this terminal-equipped electrical wire 10 is excellent in impact resistance and fatigue characteristics, and also has a small connection resistance.

Terminal-equipped electrical wire 10 may be configured such that one terminal portion 4 is attached to each covered electrical wire 1 as shown in FIG. 2, and also may be configured such that one terminal portion (not shown) is provided in a plurality of covered electrical wires 1. When a plurality of covered electrical wires 1 are bundled with a bundling tool or the like, terminal-equipped electrical wire 10 can be easily handled.

[Method of Manufacturing Al alloy wire and Method of Manufacturing Al Alloy Strand Wire]

(Summary)

Al alloy wire 22 in the embodiment can be representatively manufactured by performing heat treatment (including softening treatment) at an appropriate timing in addition to the basic step such as casting, (hot) rolling, extrusion, and wire drawing. Known conditions and the like can be applied as the conditions of the basic step, the softening treatment, and the like. Al alloy strand wire 20 in the embodiment can be manufactured by stranding a plurality of Al alloy wires 22 together. Known conditions can be applied as the stranding conditions and the like.

(Casting Step)

Particularly, Al alloy wire 22 in the embodiment having a surface layer including a certain amount of fine crystallized materials is readily manufactured, for example, when the cooling rate in the casting process, particularly the cooling rate in the specific temperature range from the temperature of melt up to 650° C., is raised to some extent. This is because the above-mentioned specific temperature range is mainly a liquid phase range, and thus, when the cooling rate in the liquid phase range is raised, the crystallized material produced during solidification is readily reduced in size. However, it is considered that, when the cooling rate is too high in the case where the temperature of melt is lowered as described later, particularly when the cooling rate is equal to or more than 25° C./second, the crystallized material is less likely to be produced, so that the dissolution amount of additive element is increased to thereby lower the electrical conductivity, and so that the pinning effect of crystal grains by the crystallized material is less likely to be achieved. In contrast, when the temperature of melt is set to be relatively low and the cooling rate in the above-mentioned temperature range is accelerated to some extent, a coarse crystallized material is less likely to be contained while a certain amount of fine crystallized materials having a relatively uniform size is more likely to be contained. Eventually, Al alloy wire 22 having a surface layer containing a certain amount of fine crystallized materials can be manufactured.

Although depending on the contents of additive elements such as Fe, when the cooling rate in the above-mentioned specific temperature range is, for example, equal to or higher than 1° C./second, and further, equal to or higher than 2° C./second, and also, equal to or higher than 4° C./second, the crystallized materials are readily finely grained. Also, when the cooling rate in the above-mentioned specific temperature range is set to be equal to or less than 30° C./second, further, less than 25° C./second, equal to or less than 20° C./second, less than 20° C./second, equal to or less than 15° C./second, and equal to or less than 10° C./second, an appropriate amount of crystallized materials is readily produced. When the above-mentioned cooling rate is not excessively high, it is also suitable for mass production.

It has been found that the above-mentioned Al alloy wire 22 containing a small amount of voids can be manufactured by setting the temperature of melt to be relatively low as described above. When the temperature of melt is set to be relatively low, dissolution of gas in the atmosphere into a melt can be reduced, so that a cast material can be manufactured with a melt containing a small amount of dissolved gas. Examples of dissolved gas may be hydrogen as described above. This hydrogen is considered as a decomposition of water vapor in the atmosphere, and considered to be contained in the atmosphere. When a cast material with a small amount of dissolved gas such as dissolved hydrogen is used as a base material, it becomes possible to readily maintain the state where the Al alloy contains a small amount of voids, which result from dissolved gas, at and after casting despite plastic working such as rolling and wire drawing or heat treatment such as softening treatment. As a result, the voids existing in the surface layer and the inside of Al alloy wire 22 having a final wire diameter can be set to fall within the above-described specific range. Also, Al alloy wire 22 containing a small amount of hydrogen as described above can be manufactured. It is considered that the positions of voids confined inside the Al alloy are changed and the sizes of voids are reduced to some extent by performing treatment (rolling, extrusion, wire drawing and the like) involving the steps subsequent to the casting process, for example, stripping and plastic deformation. However, it is considered that, when the total content of voids existing in the cast material is relatively large, the total content of voids and the hydrogen content existing in the surface layer and inside of the Al alloy wire having a final wire diameter are more likely to be increased (substantially remained maintained), even if the positions and the sizes of the voids are changed. In contrast, by lowering the temperature of melt to sufficiently reduce the voids contained in the cast material itself, Al alloy wire 22 containing a small amount of voids can be manufactured. The lower temperature of melt can further reduce the dissolved gas and also can reduce the voids in the cast material. Also, by lowering the temperature of melt, even when casting is performed in the atmosphere containing water vapor such as an air atmosphere, dissolved gas can be reduced, with the result that the total content of voids and the content of hydrogen that result from the dissolved gas can be reduced. It is considered that, in addition to lowering of the temperature of melt, by raising the cooling rate in the above-mentioned specific temperature range in the casting process to some extent as described above, dissolved gas from the atmosphere can be readily prevented from increasing, and also, by not excessively raising the cooling rate, the dissolved gas inside the metal during solidification is readily discharged into the atmosphere on the outside. As a result, the total content of voids resulting from dissolved gas and the content of hydrogen can be furthermore reduced.

Examples of specific temperature of melt may be equal to or more than the liquidus temperature and less than 750° C. in the Al alloy. It is preferable that the temperature of melt is equal to or less than 748° C., and also, equal to or less than 745° C. since the lower temperature of melt can further reduce dissolved gas and further reduce the voids in the cast material. On the other hand, when the temperature of melt is high to some extent, additive elements are readily dissolved. Accordingly, the temperature of melt can be set to be equal to or more than 670° C., and also, equal to or more than 675° C. Thus, an Al alloy wire excellent in strength, toughness and the like is readily achieved. When the cooling rate in the above-mentioned specific temperature range is set to fall within a specific range while setting the temperature of melt to be relatively low, the fine crystallized materials can be contained to some extent as described above, and additionally, the voids in the casting material can be readily reduced in size and amount. This is due to the following reason. Specifically, hydrogen and the like are readily dissolved in the above-mentioned temperature range up to 650° C. and the dissolved gas is readily increased. However, when the above-mentioned cooling rate is set to fall within the above-mentioned specific range, an increase in dissolved gas can be suppressed. Also, when the cooling rate is not too high, the dissolved gas inside the metal during solidification is readily discharged into the atmosphere on the outside. Based on the above, it is more preferable that the temperature of melt is set to be equal to or greater than 670° C. and less than 750° C., and that the cooling rate from the temperature of melt to 650° C. is set to be less than 20° C./second.

Furthermore, when the cooling rate in the casting process is accelerated in the above-described range, it is expectable to achieve such effects as that: a cast material having a fine crystal structure is readily achieved; additive elements are readily dissolved to some extent; and the dendrite arm spacing (DAS) is readily reduced (for example, to be equal to or less than 50 μm, and also equal to or less than 40 μm).

Both continuous casting and metal mold casting (billet casting) can be utilized for casting. Continuous casting allows continuous production of an elongated cast material and also facilitates acceleration of the cooling rate. Thus, it is expectable to achieve effects of: suppressing a coarse crystallized material; reducing voids; forming a finer crystal grain and a finer DAS; dissolving an additive element; and the like, as described above.

(Step to Wire Drawing)

An intermediate working material obtained representatively by subjecting a cast material to plastic working (intermediate working) such as (hot) rolling and extrusion is subjected to wire drawing. Also, by performing hot rolling subsequent to continuous casting, a continuous cast and rolled material (an example of the intermediate working material) can also be subjected to wire drawing. Stripping and heat treatment can be performed before and after the above-mentioned plastic working. By stripping, the surface layer that may include voids, a surface flaw and the like can be removed. The heat treatment performed in this case may be performed, for example, for the purpose of achieving homogenization of an Al alloy, or the like. The conditions of homogenization treatment may be set such that the heating temperature is equal to or more than about 450° C. and equal to or less than about 600° C., and the retention time is equal to or longer than about 0.5 hours and equal to or shorter than about 5 hours. When the homogenization treatment is performed under these conditions, a crystallized material that is uneven and coarse due to segregation is readily finely grained and uniformly sized to some extent. It is preferable to perform homogenization treatment after casting when a billet cast material is used.

(Wire Drawing Step)

The base material (intermediate working material) having been subjected to plastic working such as the above-mentioned rolling is subjected to (cold) wire drawing until a prescribed final wire diameter is achieved, thereby forming a wire-drawn member. The wire drawing is representatively performed using a wire-drawing die. Furthermore, the wire drawing is performed using a lubricant. By using a wire-drawing die having a small surface roughness of, for example, equal to or less than 3 μm as described above and by adjusting the amount of the lubricant to be applied, Al alloy wire 22 having a smooth surface having a surface roughness of equal to or less than 3 μm can be manufactured. By appropriately changing a wire-drawing die to a wire-drawing die having a small surface roughness, a wire-drawn member having a smooth surface can be manufactured continuously. The surface roughness of the wire-drawing die can be readily measured by using the surface roughness of the wire-drawn member as an alternative value therefor. By adjusting the amount of application of the lubricant or adjusting the below-mentioned heat treatment condition, Al alloy wire 22 can be manufactured in which the amount of adhesion of C in the surface of Al alloy wire 22 falls within the above-described specific range. Accordingly, Al alloy wire 22 having a dynamic friction coefficient falling within the above-described specific range can be manufactured. The wire-drawing degree may be selected as appropriate in accordance with the final wire diameter.

(Stranding Step)

For manufacturing Al alloy strand wire 20, a plurality of wire members (wire-drawn members or heat treated members subjected to heat treatment after wire drawing) are prepared and stranded together in a prescribed strand pitch (for example, 10 times to 40 times as high as the pitch diameter). A lubricant may be used during wire stranding. For forming Al alloy strand wire 20 as a compressed strand wire, wire members are stranded and thereafter compression-molded into a prescribed shape.

(Heat Treatment)

Heat treatment can be performed for the wire-drawn member at an appropriate timing during and after wire drawing. Particularly when softening treatment for the purpose of improving toughness such as breaking elongation is performed, Al alloy wire 22 and Al alloy strand wire 20 having high strength and high toughness and also having excellent impact resistance and excellent fatigue characteristics can be manufactured. The heat treatment may be performed at least one of timings including: during wire drawing; after wire drawing (before wire stranding); after wire stranding (before compression molding); and after compression molding. Heat treatment may be performed at a plurality of timings. Heat treatment may be performed by adjusting the heat treatment conditions such that Al alloy wire 22 and Al alloy strand wire 20 as end products satisfy desired characteristics, for example, such that the breaking elongation becomes equal to or more than 10%. By performing heat treatment (softening treatment) such that breaking elongation becomes equal to or more than 10%, Al alloy wire 22 having a work hardening exponent falling within the above-mentioned specific range can also be manufactured. When heat treatment is performed in the middle of wire drawing or before wire stranding, the workability is enhanced, so that wire drawing, wire stranding and the like can be readily performed.

Heat treatment can be utilized in each of: continuous treatment in which a subject to be heat-treated is continuously supplied into a heating container such as a pipe furnace or an electricity furnace; and batch treatment in which a subject to be heat-treated is heated in the state where the subject is enclosed in a heating container such as an atmosphere furnace. The batch treatment conditions may be set, for example, such that the heating temperature is equal to or more than about 250° C. and equal to or less than about 500° C., and the retention time is equal to or longer than about 0.5 hours and equal to or shorter than about 6 hours. In the continuous treatment, the control parameter may be adjusted such that the wire member after heat treatment satisfies desired characteristics. The continuous treatment conditions are readily adjusted when the correlation data between the characteristics and the parameter values are prepared in advance so as to satisfy desired characteristics in accordance with the dimensions (a wire diameter, a cross-sectional area and the like) of the subject to be heat-treated (see PTL 1). Furthermore, the heat treatment conditions can be adjusted so as to achieve a desired value of a remaining amount of the lubricant after the heat treatment by measuring the amount of lubricant before the heat treatment in advance. As the heating temperature is higher or as the retention time is longer, the remaining amount of the lubricant tends to be smaller.

Examples of the atmosphere during heat treatment may be: an atmosphere such as an air atmosphere containing a relatively large amount of oxygen; or a low-oxygen atmosphere containing oxygen less than that in atmospheric air. In the case of an air atmosphere, the atmosphere does not have to be controlled, but a surface oxide film is more likely to be formed thicker (for example, equal to or more than 50 nm). Thus, in the case of an air atmosphere, by employing continuous treatment facilitating a shorter retention time, Al alloy wire 22 including a surface oxide film having a thickness falling within the above-mentioned specific range is readily manufactured. Examples of low-hydrogen atmosphere may be a vacuum atmosphere (a decompressed atmosphere), an inactive gas atmosphere, a reducing gas atmosphere, and the like. Examples of inert gas may be nitrogen, argon, and the like. Examples of reducing gas may be hydrogen gas, hydrogen mixed gas containing hydrogen and inert gas, mixed gas of carbon monoxide and carbon dioxide, and the like. In a low-oxygen atmosphere, the atmosphere has to be controlled, but the surface oxide film is more likely to be formed thinner (for example, less than 50 nm). Accordingly, in the case of a low-oxygen atmosphere, by employing batch treatment allowing easy atmosphere control, it becomes possible to readily manufacture Al alloy wire 22 including a surface oxide film having a thickness falling within the above-mentioned specific range and preferably Al alloy wire 22 including a thinner surface oxide film.

When the composition of the Al alloy is adjusted as described above (preferably, both Ti and B are added) and a continuous cast material or a continuous cast and rolled material is used as a base material, Al alloy wire 22 exhibiting a crystal grain size falling within the above-mentioned range is readily manufactured. Particularly when the wire-drawn member having a final wire diameter, the strand wire or the compressed strand wire is subjected to heat treatment (softening treatment) such that the breaking elongation becomes equal to or more than 10% while setting the wire drawing degree to be 80% or more at which the base material obtained by subjecting a continuous cast material to plastic working such as rolling or the continuous cast and rolled material is processed and formed into an wire-drawn member having a final wire diameter, Al alloy wire 22 having a crystal grain size equal to or less than 50 μm is further readily manufactured. In this case, heat treatment may also be performed in the middle of wire drawing. By controlling a crystal structure and also controlling breaking elongation in this way, Al alloy wire 22 exhibiting a work hardening exponent falling within the above-mentioned specific range can also be manufactured.

(Other Steps)

In addition, examples of the method of adjusting the thickness of a surface oxide film may be: exposing the wire-drawn member having a final wire diameter under the existence of hot water of high temperature and high pressure; applying water to the wire-drawn member having a final wire diameter; providing a drying step after water-cooling when water-cooling is performed after heat treatment in the continuous treatment in an air atmosphere; and the like. The surface oxide film tends to be increased in thickness by exposure to hot water and application of water. By drying after water-cooling as described above, formation of a boehmite layer resulting from water-cooling is prevented, so that a surface oxide film tends to be formed thinner. By using a water-cooling coolant obtained by adding ethanol to water, degreasing can also be performed simultaneously with cooling.

By the above-mentioned heat treatment, or by performing degreasing treatment and the like, when a small amount of lubricant or substantially no lubricant adheres to the surface of Al alloy wire 22, the lubricant can be applied with a prescribed amount of adhesion. In this case, the amount of adhesion of lubricant can be adjusted by using the amount of adhesion of C and the dynamic friction coefficient as indexes. Degreasing treatment can be performed using a known method and can also be combined with cooling as described above.

[Method of Manufacturing Covered Electrical Wire]

Covered electrical wire 1 in the embodiment can be manufactured by preparing Al alloy wire 22 or Al alloy strand wire 20 (which may be a compressed strand wire) in the embodiment that forms conductor 2, and forming insulation cover 3 on the outer circumference of conductor 2 by extrusion or the like. Known conditions can be applied as the extrusion conditions and the like.

[Method of Manufacturing Terminal-Equipped Electrical Wire]

Terminal-equipped electrical wire 10 in the embodiment can be manufactured by removing insulation cover 3 from the end portion of covered electrical wire 1 so as to expose conductor 2 to which terminal portion 4 is attached.

Test Example 1

Al alloy wires were produced under various conditions to examine the characteristics thereof. Also, these Al alloy wires were used to produce an Al alloy strand wire, and further, a covered electrical wire including this Al alloy strand wire as a conductor was produced. Then, a crimp terminal was attached to an end portion of the covered electrical wire, to thereby obtain a terminal-equipped covered electrical wire. The characteristics of the terminal-equipped covered electrical wire were examined.

The Al alloy wire is produced as follows.

Pure aluminum (99.7 mass % or more of Al) was prepared as a base material and dissolved to obtain a melt (molten aluminum), into which additive elements shown in Tables 1 to 4 were added in content (mass %) as shown in Tables 1 to 4, thereby producing a melt of an Al alloy. When the melt of the Al alloy having been subjected to component adjustment is subjected to hydrogen-gas removing treatment and foreign-substance removing treatment, the hydrogen content can be readily reduced and foreign substances can be readily reduced.

The prepared melt of the Al alloy is used to produce a continuous cast and rolled material or a billet cast material. The continuous cast and rolled material is produced by continuously performing casting and hot rolling using a belt wheel-type continuous casting rolling machine and the prepared melt of Al alloy, thereby forming a wire rod of ϕ 9.5 mm. The melt of Al alloy is poured into a prescribed fixed mold and then cooled to thereby produce a billet cast material. The billet cast material is homogenized and thereafter subjected to hot-rolling to thereby produce a wire rod (rolled material) of ϕ 9.5 mm. Tables 5 to 8 shows the types of the casting method (a continuous cast and rolled material is indicated as "continuous" and a billet cast material is indicated as "billet"), the temperature of melt (° C.), and the cooling rate in the casting process (the average cooling rate from the temperature of melt to 650° C.; ° C./second). The cooling rate was changed by adjusting the cooling state using a water-cooling mechanism or the like.

The above-mentioned wire rod is subjected to cold wire-drawing to produce a wire-drawn member having a wire diameter of ϕ 0.3 mm, a wire-drawn member having a wire diameter of ϕ 0.37 mm, and a wire-drawn member having a wire diameter of ϕ 0.39 mm. In this case, wire drawing is performed using a wire-drawing die and a commercially available lubricant (an oil agent containing carbon). The wire-drawing dies having different surface roughnesses are prepared and replaced as appropriate. Also, the amount of lubricant to be used is adjusted to thereby adjust the surface roughness of the wire-drawn member of each sample. For sample No. 3-10, a wire-drawing die having a surface roughness greater than those of other samples is used. For each of samples No. 2-208 and No. 3-307, a wire-drawing die having the greatest surface roughness is used.

The obtained wire-drawn member having a wire diameter of ϕ 0.3 mm is subjected to softening treatment by the method, at the temperature (° C.) and in the atmosphere shown in Tables 5 to 8 to thereby produce a softened member (an Al alloy wire). The "bright softening" indicated as a method in Tables 5 to 8 is batch treatment using a box-type furnace, in which the retention time is set at three hours. The "continuous softening" indicated as a method in Tables 5 to 8 is continuous treatment in a high-frequency induction heating scheme or a direct energizing scheme, in which the energizing conditions are controlled so as to achieve the temperatures (measured by an contactless infrared thermometer) shown in Tables 5 to 8. The linear velocity is selected from the range of 50 m/min to 3,000 m/min. Sample No. 2-202 is not subjected to softening treatment. Sample No. 2-204 is treated under heat treatment conditions, such as 550° C.×8 hours, that are higher in temperature and longer in time period than other samples ("*1" is added to the column of temperature in Table 8). Sample No. 2-209 is subjected to boehmite treatment (100° C.×15 minutes) after softening treatment in an air atmosphere ("*2" is added to the column of atmosphere in Table 8).

TABLE 1

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 1-1 | 0.1 | — | — | — | — | — | — | — | — | — | 0 | 0 | 0.01 | 0.002 |
| 1-2 | 0.2 | — | — | — | — | — | — | — | — | — | 0 | 0 | 0.02 | 0.004 |
| 1-3 | 0.6 | — | — | — | — | — | — | — | — | — | 0 | 0 | 0.02 | 0.004 |
| 1-4 | 1 | — | — | — | — | — | — | — | — | — | 0 | 0 | 0.03 | 0.005 |
| 1-5 | 1 | — | — | — | — | — | — | — | — | — | 0 | 0 | 0.03 | 0.015 |
| 1-6 | 1.7 | — | — | — | — | — | — | — | — | — | 0 | 0 | 0.02 | 0.004 |
| 1-7 | 2 | — | — | — | — | — | — | — | — | — | 0 | 0 | 0 | 0 |

TABLE 1-continued

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 1-8 | 2.2 | — | — | — | — | — | — | — | — | — | 0 | 0 | 0.02 | 0.004 |
| 1-9 | 0.5 | — | 0.03 | — | — | — | — | — | — | — | 0 | 0.03 | 0.01 | 0.002 |
| 1-10 | 0.5 | — | 0.25 | — | — | — | — | — | — | — | 0 | 0.25 | 0.01 | 0.002 |
| 1-11 | 0.5 | — | — | — | 0.005 | — | — | — | — | — | 0.005 | 0.005 | 0.01 | 0 |
| 1-12 | 0.5 | — | — | — | 0.08 | — | — | — | — | — | 0.08 | 0.08 | 0.02 | 0.004 |
| 1-13 | 0.5 | — | — | — | — | 0.005 | — | — | — | — | 0.005 | 0.005 | 0.02 | 0 |
| 1-14 | 0.5 | — | — | — | — | 0.1 | — | — | — | — | 0.1 | 0.1 | 0.02 | 0.004 |
| 1-15 | 0.5 | — | — | — | — | — | 0.005 | — | — | — | 0.005 | 0.005 | 0 | 0 |
| 1-16 | 0.5 | — | — | — | — | — | 0.1 | — | — | — | 0.1 | 0.1 | 0.02 | 0.004 |
| 1-17 | 1 | — | — | — | — | — | — | 0.005 | — | — | 0.005 | 0.005 | 0.02 | 0.004 |
| 1-18 | 1 | — | — | — | — | — | — | 0.02 | — | — | 0.02 | 0.02 | 0.01 | 0.002 |
| 1-19 | 1 | — | — | — | — | — | — | — | 0.005 | — | 0.005 | 0.005 | 0.01 | 0.002 |
| 1-20 | 1 | — | — | — | — | — | — | — | 0.03 | — | 0.03 | 0.03 | 0 | 0 |
| 1-21 | 1 | — | — | — | — | — | — | — | — | 0.005 | 0.005 | 0.005 | 0.01 | 0.002 |
| 1-22 | 1 | — | — | — | — | — | — | — | — | 0.07 | 0.07 | 0.07 | 0.02 | 0.004 |
| 1-23 | 1.5 | — | 0.03 | — | — | — | 0.02 | — | — | — | 0.02 | 0.05 | 0.008 | 0.002 |
| 1-101 | 0.001 | — | — | — | — | — | — | — | — | — | 0 | 0 | 0.02 | 0.004 |
| 1-102 | 0.001 | — | — | — | — | — | — | — | — | — | 0 | 0 | 0.02 | 0.004 |
| 1-103 | 2.5 | — | — | — | — | 0.5 | — | — | — | — | 0.5 | 0.5 | 0.01 | 0.002 |
| 1-104 | 2.5 | — | — | — | — | 0.5 | — | — | — | — | 0.5 | 0.5 | 0.01 | 0.002 |

TABLE 2

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 2-1 | 0.01 | 0.5 | — | — | — | — | — | — | — | — | 0 | 0.5 | 0.05 | 0.005 |
| 2-2 | 0.2 | 0.15 | — | — | — | — | — | — | — | — | 0 | 0.15 | 0 | 0 |
| 2-3 | 0.6 | 0.3 | — | — | — | — | — | — | — | — | 0 | 0.3 | 0 | 0 |
| 2-4 | 0.9 | 0.05 | — | — | — | — | — | — | — | — | 0 | 0.05 | 0.03 | 0.005 |
| 2-5 | 1 | 0.2 | — | — | — | — | — | — | — | — | 0 | 0.2 | 0.02 | 0.004 |
| 2-6 | 1.05 | 0.15 | — | — | — | — | — | — | — | — | — | 0.15 | 0.03 | 0.002 |
| 2-7 | 1.5 | 0.15 | — | — | — | — | — | — | — | — | 0 | 0.15 | 0.02 | 0.004 |
| 2-8 | 2.2 | 0.25 | — | — | — | — | — | — | — | — | 0 | 0.25 | 0.01 | 0 |
| 2-9 | 1 | 0.2 | 0.04 | — | — | — | — | — | — | — | 0 | 0.24 | 0.03 | 0.005 |
| 2-10 | 1 | 0.2 | 0.3 | — | — | — | — | — | — | — | 0 | 0.5 | 0.02 | 0.004 |
| 2-11 | 1 | 0.2 | — | — | 0.005 | — | — | — | — | — | 0.005 | 0.205 | 0.01 | 0.002 |
| 2-12 | 1 | 0.2 | — | — | 0.05 | — | — | — | — | — | 0.05 | 0.25 | 0.02 | 0.004 |
| 2-13 | 1 | 0.2 | — | — | — | 0.005 | — | — | — | — | 0.005 | 0.205 | 0.01 | 0 |
| 2-14 | 1 | 0.2 | — | — | — | 0.05 | — | — | — | — | 0.05 | 0.25 | 0.01 | 0 |
| 2-15 | 1 | 0.2 | — | — | — | — | 0.005 | — | — | — | 0.005 | 0.205 | 0.02 | 0.004 |
| 2-16 | 1 | 0.2 | — | — | — | — | 0.05 | — | — | — | 0.05 | 0.25 | 0.02 | 0.004 |
| 2-17 | 1 | 0.2 | — | — | — | — | — | 0.005 | — | — | 0.005 | 0.205 | 0.02 | 0.004 |
| 2-18 | 1 | 0.2 | — | — | — | — | — | 0.2 | — | — | 0.2 | 0.4 | 0.02 | 0.004 |
| 2-19 | 1 | 0.2 | — | — | — | — | — | — | 0.005 | — | 0.005 | 0.205 | 0.01 | 0 |
| 2-20 | 1 | 0.2 | — | — | — | — | — | — | 0.05 | — | 0.05 | 0.25 | 0.02 | 0.004 |
| 2-21 | 1 | 0.2 | — | — | — | — | — | — | — | 0.005 | 0.005 | 0.205 | 0.01 | 0.002 |
| 2-22 | 1 | 0.2 | — | — | — | — | — | — | — | 0.01 | 0.01 | 0.21 | 0.02 | 0.004 |
| 2-23 | 1 | 0.2 | 0.03 | — | — | 0.005 | — | — | — | 0.005 | 0.01 | 0.24 | 0.01 | 0.002 |
| 2-201 | 3 | 0.8 | — | — | — | — | 3 | — | — | — | 3 | 3.8 | 0.01 | 0.002 |
| 2-202 | 1.05 | 0.2 | — | — | 0.05 | — | — | — | — | — | 0.05 | 0.25 | 0.02 | 0.005 |

TABLE 3

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 3-1 | 0.1 | — | — | 0.05 | — | — | — | — | — | — | 0 | 0.05 | 0.02 | 0.004 |
| 3-2 | 0.1 | — | — | 0.5 | — | — | — | — | — | — | 0 | 0.5 | 0.01 | 0.002 |

TABLE 3-continued

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 3-3 | 1 | — | — | 0.1 | — | — | — | — | — | — | 0 | 0.1 | 0.02 | 0 |
| 3-4 | 1.5 | — | — | 0.1 | — | — | — | — | — | — | 0 | 0.1 | 0.01 | 0.002 |
| 3-5 | 2.2 | — | — | 0.1 | — | — | — | — | — | — | 0 | 0.1 | 0 | 0 |
| 3-6 | 0.2 | 0.1 | — | 0.2 | — | — | — | — | — | — | 0 | 0.3 | 0.01 | 0 |
| 3-7 | 0.2 | — | 0.05 | 0.2 | — | — | — | — | — | — | 0 | 0.25 | 0.02 | 0.004 |
| 3-8 | 0.8 | — | — | 0.2 | — | 0.005 | — | — | — | — | 0.005 | 0.205 | 0.02 | 0.004 |
| 3-9 | 0.8 | — | — | 0.2 | — | — | — | — | 0.005 | — | 0.005 | 0.205 | 0.01 | 0.002 |
| 3-10 | 0.2 | 0.1 | 0.05 | 0.2 | — | — | — | — | — | — | 0 | 0.35 | 0.02 | 0.004 |
| 3-11 | 0.2 | 0.1 | 0.05 | 0.2 | — | — | 0.01 | — | — | — | 0.01 | 0.36 | 0.02 | 0.004 |
| 3-12 | 0.2 | 0.1 | 0.05 | 0.2 | — | — | — | — | 0.05 | — | — | — | 0.01 | 0.002 |
| 3-301 | 3 | — | — | 0.6 | — | — | — | — | — | — | 0 | 0.6 | 0.01 | 0.002 |
| 3-302 | 1.05 | 0.2 | 0.5 | 0.2 | — | — | — | — | — | — | 0 | 0.9 | 0.02 | 0.005 |

TABLE 4

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 1-105 | 1 | — | — | — | — | — | — | — | — | — | 0 | 0 | 0.03 | 0.015 |
| 1-106 | 1 | — | — | — | — | — | — | — | — | — | 0 | 0 | 0.03 | 0.015 |
| 1-107 | 1 | — | — | — | — | — | — | — | — | — | 0 | 0 | 0.03 | 0.015 |
| 1-108 | 1 | — | — | — | — | — | — | — | — | — | 0 | 0 | 0.03 | 0.015 |
| 1-109 | 1 | — | — | — | — | — | — | — | — | — | 0 | 0 | 0.03 | 0.015 |
| 2-204 | 1 | 0.2 | — | — | — | — | — | — | — | — | 0 | 0.2 | 0.02 | 0.004 |
| 2-205 | 1 | 0.2 | — | — | — | — | — | — | — | — | 0 | 0.2 | 0.02 | 0.004 |
| 2-206 | 1 | 0.2 | — | — | — | — | — | — | — | — | 0 | 0.2 | 0.02 | 0.004 |
| 2-207 | 1 | 0.2 | — | — | — | — | — | — | — | — | 0 | 0.2 | 0.02 | 0.004 |
| 2-208 | 1 | 0.2 | — | — | — | — | — | — | — | — | 0 | 0.2 | 0.02 | 0.004 |
| 2-209 | 1 | 0.2 | — | — | — | — | — | — | — | — | 0 | 0.2 | 0.02 | 0.004 |
| 3-305 | 1 | — | — | 0.1 | — | — | — | — | — | — | 0 | 0.1 | 0.02 | 0 |
| 3-306 | 1 | — | — | 0.1 | — | — | — | — | — | — | 0 | 0.1 | 0.02 | 0 |
| 3-307 | 1 | — | — | 0.1 | — | — | — | — | — | — | 0 | 0.1 | 0.02 | 0 |

TABLE 5

| Sample | Manufacturing Conditions | | | | | |
|---|---|---|---|---|---|---|
| | | Casting Conditions | | | | |
| | | Temperature | Cooling | Softening Treatment (Batch × 3 H) | | |
| No. | Casting | of melt [° C.] | Rate [° C./sec] | Method | Temperature [° C.] | Atmosphere |
| 1-1 | Billet | 740 | 2 | Bright Softening | 250 | Atmospheric Air |
| 1-2 | Continuous | 690 | 22 | Bright Softening | 250 | Reducing Gas |
| 1-3 | Continuous | 740 | 4 | Bright Softening | 350 | Reducing Gas |
| 1-4 | Continuous | 710 | 10 | Continuous Softening | 500 | Atmospheric Air |
| 1-5 | Continuous | 745 | 2 | Bright Softening | 300 | Nitrogen Gas |
| 1-6 | Continuous | 720 | 3 | Bright Softening | 350 | Reducing Gas |
| 1-7 | Continuous | 700 | 7 | Continuous Softening | 500 | Atmospheric Air |
| 1-8 | Continuous | 680 | 4 | Bright Softening | 400 | Reducing Gas |
| 1-9 | Continuous | 720 | 2 | Bright Softening | 450 | Reducing Gas |
| 1-10 | Continuous | 670 | 9 | Continuous Softening | 500 | Atmospheric Air |
| 1-11 | Billet | 730 | 9 | Bright Softening | 250 | Atmospheric Air |
| 1-12 | Continuous | 740 | 2 | Bright Softening | 500 | Nitrogen Gas |
| 1-13 | Continuous | 680 | 2 | Continuous Softening | 450 | Atmospheric Air |
| 1-14 | Continuous | 710 | 2 | Bright Softening | 450 | Reducing Gas |
| 1-15 | Continuous | 745 | 4 | Bright Softening | 250 | Atmospheric Air |
| 1-16 | Continuous | 740 | 4 | Bright Softening | 350 | Reducing Gas |
| 1-17 | Billet | 680 | 5 | Continuous Softening | 400 | Atmospheric Air |
| 1-18 | Continuous | 690 | 2 | Bright Softening | 300 | Reducing Gas |

TABLE 5-continued

| Manufacturing Conditions | | | | | | |
|---|---|---|---|---|---|---|
| | | Casting Conditions | | Softening Treatment (Batch × 3 H) | | |
| Sample No. | Casting | Temperature of melt [° C.] | Cooling Rate [° C./sec] | Method | Temperature [° C.] | Atmosphere |
| 1-19 | Continuous | 690 | 25 | Bright Softening | 250 | Reducing Gas |
| 1-20 | Continuous | 710 | 2 | Continuous Softening | 400 | Atmospheric Air |
| 1-21 | Billet | 730 | 1 | Bright Softening | 300 | Nitrogen Gas |
| 1-22 | Continuous | 670 | 4 | Continuous Softening | 550 | Atmospheric Air |
| 1-23 | Continuous | 730 | 2 | Bright Softening | 350 | Reducing Gas |
| 1-101 | Continuous | 700 | 2 | Bright Softening | 250 | Reducing Gas |
| 1-102 | Continuous | 680 | 4 | Bright Softening | 400 | Reducing Gas |
| 1-103 | Continuous | 700 | 3 | Bright Softening | 400 | Reducing Gas |
| 1-104 | Continuous | 700 | 3 | Bright Softening | 250 | Reducing Gas |

TABLE 6

| Manufacturing Conditions | | | | | | |
|---|---|---|---|---|---|---|
| | | Casting Conditions | | Softening Treatment (Batch × 3 H) | | |
| Sample No. | Casting | Temperature of melt [° C.] | Cooling Rate [° C./sec] | Method | Temperature [° C.] | Atmosphere |
| 2-1 | Billet | 720 | 3 | Bright Softening | 300 | Reducing Gas |
| 2-2 | Billet | 720 | 4 | Bright Softening | 250 | Reducing Gas |
| 2-3 | Continuous | 720 | 10 | Bright Softening | 325 | Nitrogen Gas |
| 2-4 | Continuous | 745 | 3 | Continuous Softening | 500 | Atmospheric Air |
| 2-5 | Continuous | 700 | 2 | Bright Softening | 350 | Reducing Gas |
| 2-6 | Continuous | 700 | 6 | Batch Softening | 350 | Reducing Gas |
| 2-7 | Billet | 680 | 5 | Bright Softening | 250 | Reducing Gas |
| 2-8 | Continuous | 740 | 2 | Bright Softening | 400 | Reducing Gas |
| 2-9 | Continuous | 720 | 4 | Continuous Softening | 500 | Atmospheric Air |
| 2-10 | Continuous | 680 | 2 | Bright Softening | 400 | Nitrogen Gas |
| 2-11 | Continuous | 690 | 3 | Bright Softening | 350 | Nitrogen Gas |
| 2-12 | Continuous | 670 | 2 | Bright Softening | 300 | Reducing Gas |
| 2-13 | Billet | 670 | 20 | Bright Softening | 325 | Reducing Gas |
| 2-14 | Continuous | 710 | 3 | Bright Softening | 275 | Nitrogen Gas |
| 2-15 | Continuous | 710 | 2 | Bright Softening | 300 | Reducing Gas |
| 2-16 | Continuous | 730 | 2 | Bright Softening | 350 | Reducing Gas |
| 2-17 | Continuous | 680 | 4 | Bright Softening | 300 | Reducing Gas |
| 2-18 | Continuous | 670 | 2 | Bright Softening | 350 | Reducing Gas |
| 2-19 | Continuous | 740 | 1 | Continuous Softening | 500 | Atmospheric Air |
| 2-20 | Continuous | 700 | 8 | Bright Softening | 350 | Nitrogen Gas |
| 2-21 | Continuous | 690 | 6 | Continuous Softening | 500 | Atmospheric Air |
| 2-22 | Continuous | 690 | 20 | Bright Softening | 300 | Reducing Gas |
| 2-23 | Billet | 720 | 2 | Bright Softening | 350 | Reducing Gas |
| 2-201 | Continuous | 745 | 2 | Bright Softening | 350 | Reducing Gas |
| 2-202 | Continuous | 670 | 11 | None | None | None |

TABLE 7

| Manufacturing Conditions | | | | | | |
|---|---|---|---|---|---|---|
| | | Casting Conditions | | Softening Treatment (Batch × 3 H) | | |
| Sample No. | Casting | Temperature of melt [° C.] | Cooling Rate [° C./sec] | Method | Temperature [° C.] | Atmosphere |
| 3-1 | Continuous | 690 | 2 | Bright Softening | 275 | Nitrogen Gas |
| 3-2 | Continuous | 680 | 6 | Continuous Softening | 500 | Atmospheric Air |
| 3-3 | Continuous | 690 | 4 | Bright Softening | 300 | Nitrogen Gas |
| 3-4 | Continuous | 710 | 2 | Continuous Softening | 475 | Atmospheric Air |

TABLE 7-continued

| Manufacturing Conditions | | | | | | |
|---|---|---|---|---|---|---|
| | | Casting Conditions | | | | |
| | | Temperature | Cooling | Softening Treatment (Batch × 3 H) | | |
| Sample No. | Casting | of melt [° C.] | Rate [° C./sec] | Method | Temperature [° C.] | Atmosphere |
| 3-5 | Continuous | 740 | 2 | Bright Softening | 300 | Nitrogen Gas |
| 3-6 | Billet | 690 | 2 | Bright Softening | 350 | Reducing Gas |
| 3-7 | Continuous | 700 | 2 | Bright Softening | 250 | Reducing Gas |
| 3-8 | Continuous | 730 | 2 | Continuous Softening | 525 | Atmospheric Air |
| 3-9 | Continuous | 690 | 6 | Bright Softening | 275 | Atmospheric Air |
| 3-10 | Billet | 700 | 2 | Bright Softening | 350 | Reducing Gas |
| 3-11 | Continuous | 680 | 19 | Bright Softening | 325 | Reducing Gas |
| 3-12 | Continuous | 680 | 2 | Bright Softening | 350 | Atmospheric Air |
| 3-301 | Continuous | 690 | 2 | Bright Softening | 350 | Reducing Gas |
| 3-302 | Continuous | 660 | 3 | Bright Softening | 350 | Reducing Gas |

TABLE 8

| Manufacturing Conditions | | | | | | |
|---|---|---|---|---|---|---|
| | | Casting Conditions | | | | |
| | | Temperature | Cooling | Softening Treatment (Batch × 3 H) | | |
| Sample No. | Casting | of melt [° C.] | Rate [° C./sec] | Method | Temperature [° C.] | Atmosphere |
| 1-105 | Continuous | 820 | 2 | Bright Softening | 300 | Nitrogen Gas |
| 1-106 | Continuous | 750 | 25 | Bright Softening | 300 | Nitrogen Gas |
| 1-107 | Continuous | 745 | 0.5 | Bright Softening | 300 | Nitrogen Gas |
| 1-108 | Continuous | 745 | 2 | Bright Softening | 300 | Nitrogen Gas |
| 1-109 | Continuous | 745 | 2 | Bright Softening | 300 | Nitrogen Gas |
| 2-204 | Continuous | 720 | 2 | Bright Softening | *1 | Reducing Gas |
| 2-205 | Continuous | 850 | 0.2 | Bright Softening | 350 | Reducing Gas |
| 2-206 | Continuous | 700 | 0.5 | Bright Softening | 350 | Reducing Gas |
| 2-207 | Continuous | 720 | 2 | Bright Softening | 350 | Reducing Gas |
| 2-208 | Continuous | 710 | 2 | Bright Softening | 350 | Reducing Gas |
| 2-209 | Continuous | 690 | 2 | Bright Softening | 350 | *2 |
| 3-305 | Continuous | 850 | 4 | Bright Softening | 300 | Nitrogen Gas |
| 3-306 | Continuous | 690 | 0.5 | Bright Softening | 300 | Nitrogen Gas |
| 3-307 | Continuous | 690 | 4 | Bright Softening | 300 | Nitrogen Gas |

(Mechanical Characteristics and Electrical Characteristics)

As to the obtained softened member and non-heat-treated member (sample No. 2-202) having a wire diameter of 4) 0.3 mm, the tensile strength (MPa), the 0.2% proof stress (MPa), the breaking elongation (%), the work hardening exponent, and the electrical conductivity (% IACS) were measured. Also, the ratio "proof stress/tensile" of the 0.2% proof stress to the tensile strength was calculated. These results are shown in Tables 9 to 12.

The tensile strength (MPa), the 0.2% proof stress (MPa) and the breaking elongation (%) were measured by using a general tensile testing machine on the basis of JIS Z 2241 (Tensile testing method for metallic materials, 1998). The work hardening exponent is defined as an exponent n of true a strain c in an expression $\sigma=C\times\varepsilon^{n}$ of true stress a and true strain c in a plastic strain region obtained when the test force of the tensile test is applied in the single axis direction. In the above-mentioned expression, C is a strength constant. The above-mentioned exponent n is calculated by creating an S-S curve by performing a tensile test using the above-mentioned tensile testing machine (also see JIS G 2253 in 2011). The electrical conductivity (% IACS) was measured by the bridge method.

(Fatigue Characteristics)

The obtained softened member and non-heat-treated member (sample No. 2-202) each having a wire diameter of 4) 0.3 mm were subjected to a bending test to measure the number of times of bending until occurrence of breakage. The bending test was measured using a commercially available repeated-bending test machine. In this case, a jig capable of applying 0.3% of bending distortion to the wire member of each sample is used to perform repeated bending in the state where a load of 12.2 MPa is applied. The bending test is performed for three or more materials for each sample, and the average (the number) of times of bending is shown in Tables 9 to 12. It is recognized that as the number of times of bending performed until occurrence of breakage is greater, breakage resulting from repeated bending is less likely to occur, which leads to excellent fatigue characteristics.

TABLE 9

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 1-1 | 0.41 | 110 | 45 | 61 | 30 | 10243 | 0.15 |
| 1-2 | 0.41 | 114 | 47 | 61 | 25 | 11069 | 0.12 |
| 1-3 | 0.50 | 111 | 56 | 62 | 30 | 12344 | 0.15 |
| 1-4 | 0.46 | 115 | 53 | 60 | 35 | 12256 | 0.17 |
| 1-5 | 0.48 | 116 | 56 | 62 | 34 | 14090 | 0.17 |
| 1-6 | 0.60 | 127 | 76 | 60 | 25 | 15344 | 0.12 |
| 1-7 | 0.41 | 131 | 54 | 60 | 24 | 14226 | 0.12 |
| 1-8 | 0.55 | 132 | 73 | 58 | 15 | 12651 | 0.07 |
| 1-9 | 0.49 | 110 | 54 | 60 | 28 | 10494 | 0.14 |
| 1-10 | 0.51 | 120 | 62 | 55 | 15 | 13077 | 0.07 |
| 1-11 | 0.50 | 111 | 55 | 60 | 25 | 11299 | 0.12 |
| 1-12 | 0.51 | 125 | 64 | 55 | 24 | 14923 | 0.12 |
| 1-13 | 0.48 | 112 | 53 | 61 | 28 | 10460 | 0.14 |
| 1-14 | 0.50 | 118 | 58 | 59 | 24 | 11895 | 0.12 |
| 1-15 | 0.52 | 120 | 63 | 60 | 20 | 11577 | 0.10 |
| 1-16 | 0.52 | 135 | 70 | 56 | 28 | 12819 | 0.14 |
| 1-17 | 0.52 | 116 | 61 | 60 | 25 | 10683 | 0.12 |
| 1-18 | 0.48 | 117 | 56 | 60 | 33 | 12893 | 0.16 |
| 1-19 | 0.50 | 115 | 58 | 59 | 23 | 10683 | 0.11 |
| 1-20 | 0.50 | 123 | 61 | 58 | 30 | 15078 | 0.15 |
| 1-21 | 0.49 | 115 | 56 | 61 | 32 | 12325 | 0.16 |
| 1-22 | 0.50 | 130 | 66 | 58 | 31 | 14804 | 0.15 |
| 1-23 | 0.52 | 125 | 65 | 58 | 20 | 15292 | 0.10 |
| 1-101 | 0.51 | 105 | 54 | 59 | 12 | 11097 | 0.06 |
| 1-102 | 0.49 | 69 | 34 | 63 | 25 | 6730 | 0.12 |
| 1-103 | 0.53 | 106 | 56 | 59 | 30 | 11855 | 0.15 |
| 1-104 | 0.50 | 135 | 68 | 58 | 15 | 8281 | 0.07 |

TABLE 10

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 2-1 | 0.48 | 120 | 58 | 57 | 33 | 14511 | 0.16 |
| 2-2 | 0.47 | 120 | 56 | 60 | 12 | 13367 | 0.06 |
| 2-3 | 0.51 | 122 | 62 | 59 | 24 | 13451 | 0.12 |
| 2-4 | 0.54 | 121 | 65 | 59 | 25 | 12118 | 0.12 |
| 2-5 | 0.52 | 122 | 63 | 60 | 25 | 11235 | 0.12 |
| 2-6 | 0.52 | 120 | 62 | 60 | 28 | 12563 | 0.14 |
| 2-7 | 0.46 | 133 | 62 | 60 | 17 | 13739 | 0.08 |
| 2-8 | 0.48 | 128 | 62 | 57 | 25 | 14126 | 0.12 |
| 2-9 | 0.52 | 123 | 64 | 60 | 24 | 11349 | 0.12 |
| 2-10 | 0.49 | 122 | 60 | 59 | 23 | 13511 | 0.11 |
| 2-11 | 0.51 | 121 | 62 | 59 | 25 | 14317 | 0.12 |
| 2-12 | 0.46 | 128 | 60 | 58 | 22 | 11882 | 0.11 |
| 2-13 | 0.50 | 120 | 60 | 59 | 28 | 13121 | 0.14 |
| 2-14 | 0.47 | 129 | 61 | 59 | 20 | 12673 | 0.10 |
| 2-15 | 0.50 | 122 | 61 | 60 | 26 | 12815 | 0.13 |
| 2-16 | 0.50 | 129 | 65 | 57 | 27 | 13494 | 0.13 |
| 2-17 | 0.50 | 124 | 61 | 59 | 24 | 11491 | 0.12 |
| 2-18 | 0.52 | 130 | 68 | 59 | 24 | 13068 | 0.12 |
| 2-19 | 0.47 | 122 | 57 | 60 | 26 | 13013 | 0.13 |
| 2-20 | 0.52 | 125 | 65 | 55 | 24 | 14398 | 0.12 |
| 2-21 | 0.50 | 120 | 60 | 58 | 27 | 12916 | 0.13 |
| 2-22 | 0.52 | 150 | 78 | 55 | 15 | 15440 | 0.07 |
| 2-23 | 0.46 | 129 | 60 | 58 | 21 | 12423 | 0.10 |
| 2-201 | 0.54 | 170 | 92 | 40 | 7 | 17446 | 0.03 |
| 2-202 | 0.50 | 231 | 115 | 56 | 2 | 24473 | 0.01 |

TABLE 11

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 3-1 | 0.49 | 113 | 55 | 61 | 18 | 12204 | 0.09 |
| 3-2 | 0.51 | 152 | 77 | 57 | 11 | 15336 | 0.05 |
| 3-3 | 0.50 | 120 | 61 | 61 | 30 | 14395 | 0.15 |
| 3-4 | 0.57 | 131 | 75 | 60 | 27 | 16040 | 0.13 |
| 3-5 | 0.53 | 132 | 69 | 59 | 27 | 15415 | 0.13 |
| 3-6 | 0.51 | 117 | 60 | 60 | 13 | 11100 | 0.06 |
| 3-7 | 0.51 | 120 | 62 | 59 | 15 | 13878 | 0.07 |
| 3-8 | 0.48 | 117 | 56 | 61 | 30 | 12825 | 0.15 |
| 3-9 | 0.48 | 119 | 57 | 60 | 28 | 11589 | 0.14 |
| 3-10 | 0.46 | 120 | 55 | 60 | 15 | 11979 | 0.07 |
| 3-11 | 0.46 | 125 | 58 | 60 | 16 | 11682 | 0.08 |
| 3-12 | 0.51 | 126 | 65 | 59 | 17 | 15196 | 0.08 |
| 3-301 | 0.49 | 184 | 91 | 56 | 9 | 19927 | 0.04 |
| 3-302 | 0.48 | 130 | 63 | 57 | 8 | 15243 | 0.04 |

TABLE 12

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 1-105 | 0.45 | 104 | 47 | 62 | 33 | 10990 | 0.16 |
| 1-106 | 0.46 | 108 | 50 | 62 | 33 | 11523 | 0.16 |
| 1-107 | 0.49 | 107 | 52 | 62 | 25 | 12118 | 0.15 |
| 1-108 | 0.48 | 115 | 56 | 62 | 35 | 11254 | 0.17 |
| 1-109 | 0.48 | 115 | 56 | 62 | 33 | 14032 | 0.17 |
| 2-204 | 0.53 | 117 | 62 | 60 | 18 | 10742 | 0.15 |
| 2-205 | 0.48 | 112 | 54 | 60 | 24 | 7235 | 0.11 |
| 2-206 | 0.52 | 113 | 59 | 60 | 18 | 6585 | 0.12 |
| 2-207 | 0.51 | 123 | 63 | 60 | 25 | 8538 | 0.11 |
| 2-208 | 0.52 | 122 | 63 | 60 | 25 | 7302 | 0.12 |
| 2-209 | 0.51 | 124 | 63 | 60 | 25 | 12337 | 0.12 |
| 3-305 | 0.49 | 108 | 53 | 61 | 27 | 11468 | 0.15 |
| 3-306 | 0.50 | 111 | 56 | 61 | 22 | 10068 | 0.14 |
| 3-307 | 0.51 | 119 | 61 | 61 | 31 | 12135 | 0.15 |

The obtained wire-drawn member (not subjected to the above-mentioned softening treatment) having a wire diameter of ϕ 0.37 mm or a wire diameter of ϕ 0.39 mm is used to produce a strand wire. A commercially available lubricant (an oil agent containing carbon) is used for wire stranding as appropriate. In this case, the strand wire formed using seven wire members each having a wire diameter of ϕ 0.37 mm is produced. Also, a strand wire formed using seven wire members each having a wire diameter of ϕ 0.39 mm is further compression-molded to thereby produce a compressed strand wire. Each of the cross-sectional area of the strand wire and the cross-sectional area of the compressed strand wire is 0.75 $mm^2$ (0.75 sq). The strand pitch is 25 mm (approximately 33 times as high as the pitch diameter).

The obtained strand wire and compressed strand wire are subjected to softening treatment by the method, at the temperature (° C.) and in the atmosphere shown in Tables 5 to 8 (with regard to *1 in Sample No. 2-204 and *2 in Sample No. 2-209, see the above). The obtained softened strand wire is used as a conductor to form an insulation cover (0.2 mm in thickness) with an insulating material (in this case, a halogen-free insulating material) on the outer circumference of the conductor, to thereby produce a covered electrical wire. The amount of use of at least one of the lubricant during wire drawing and the lubricant during wire stranding is adjusted such that a certain amount of lubricant remains after softening treatment. For sample No. 1-20, the lubricant to be used is greater in amount than those of other samples. For sample No. 1-109, the largest amount of lubricant is used. For samples No. 1-108 and No. 2-207, degreasing treatment is performed after softening treatment. For sample No. 2-202, each of the wire-drawn member and the strand wire is not subjected to softening treatment.

The obtained covered electrical wire of each sample, or the terminal-equipped electrical wire obtained by attaching a crimp terminal to this covered electrical wire was examined regarding the following items. The following items were checked for each of the covered electrical wire including a strand wire as a conductor and the covered electrical wire including a compressed strand wire as a conductor. Tables 13 to 20 show the results obtained in the case of a strand wire used as a conductor, which were compared with the results obtained in the case of a compressed strand wire used as a conductor, to thereby check that there is no significant difference therebetween.

(Observation of Structure)

Crystallized Material

A conductor (a strand wire or a compressed strand wire formed of Al alloy wires; the rest is the same as above) in a transverse section of the covered electrical wire of each of the obtained samples was observed by a metallurgical microscope to check the crystallized materials in the surface layer and inside thereof. In this case, a surface-layer crystallization measurement region in a shape of a rectangle having a short side length of 50 μm and a long side length of 75 μm is defined within a surface layer region extending from a surface of each aluminum alloy wire forming a conductor by 50 μm in the depth direction. In other words, for one sample, one surface-layer crystallization measurement region is defined in each of seven Al alloy wires forming a strand wire to thereby define a total of seven surface-layer crystallization measurement regions. Then, the areas and the number of crystallized materials existing in each surface-layer crystallization measurement region are calculated. The average of the areas of the crystallized materials is calculated for each surface-layer crystallization measurement region. In other words, the average of the areas of the crystallized materials in the total seven measurement regions is calculated for one sample. Then, the averaged value of the averages of the areas of the crystallized materials in the total seven measurement regions for each sample is shown as an average area A ($\mu m^2$) in Tables 13 to 16.

Furthermore, the numbers of crystallized materials in the total seven surface-layer crystallization measurement regions is measured for each sample. Then, the averaged value of the number of crystallized materials in the total seven measurement regions is shown as number A (number of pieces) in Tables 13 to 16.

Furthermore, the total area of crystallized materials each having an area of 3 $\mu m^2$ or less among the crystallized materials existing in each surface-layer crystallization measurement region is checked. Then, the ratio of the total area of crystallized materials each having an area of 3 $\mu m^2$ or less to the total area of all crystallized materials existing in each surface-layer crystallization measurement region is calculated. For each sample, the above-mentioned ratio of the total areas in each of the total seven surface-layer crystallization measurement regions is checked. The averaged value of the above-mentioned ratios of the total areas in the total seven measurement regions is shown as an area ratio A (%) in Tables 13 to 16.

In place of the above-mentioned rectangular surface-layer crystallization measurement region, a sector-shaped crystallization measurement region having an area of 3750 $\mu m^2$ was defined within an annular surface layer region having a thickness of 50 $\mu m^2$. Then, in the same manner as with evaluation in the above-mentioned rectangular surface-layer crystallization measurement region, an average area B ($\mu m^2$) of the crystallized materials in the sector-shaped crystallization measurement region was calculated. Also, in the same manner as with evaluation in the above-mentioned rectangular surface-layer crystallization measurement region, the number B (number of pieces) of crystallized materials in the sector-shaped crystallization measurement region and an area ratio B (%) of the total area of the crystallized materials each having an area of 3 $\mu m^2$ or less were calculated. The results thereof are shown in Tables 13 to 16.

The area of the crystallized materials can be readily measured by subjecting the observed image to image processing such as binarization processing and extracting the crystallized materials from the processed image. The same also applies to the voids, which will be described later.

In the above-mentioned transverse section, an inside crystallization measurement region in a shape of a rectangle having a short side length of 50 μm and a long side length of 75 μm is defined in each Al alloy wire forming a conductor. The inside crystallization measurement region is defined such that the center of the rectangle coincides with the center of each Al alloy wire. Then, the average of the areas of the crystallized materials existing in each inside crystallization measurement region is calculated. The average of the areas of the crystallized materials in the total seven inside crystallization measurement regions is checked for each sample. The value obtained by further averaging the above-mentioned averages of the areas in the total seven measurement regions is defined as an average area (inside). The average areas (inside) of samples No. 1-5, No. 2-5 and No. 3-1 are 2 $\mu m^2$, 3 $\mu m^2$ and 1.5 $\mu m^2$, respectively. Other than these samples, the average areas (inside) of samples No. 1-1 to No. 1-23, No. 2-1 to No. 2-23, and No. 3-1 to No. 3-12 are equal to or greater than 0.05 $\mu m^2$ and equal to or less than 40 $\mu m^2$, and in most of the samples, equal to or less than 4 $\mu m^2$.

Voids

A conductor in a transverse section of the covered electrical wire of each of the obtained samples was observed by a scanning electron microscope (SEM) to check the voids and the crystal grain sizes in the surface layer and inside thereof. In this case, a surface-layer void measurement region in a shape of a rectangle having a short side length of 30 μm and a long side length of 50 μm is defined within a surface layer region extending from a surface of each aluminum alloy wire forming a conductor by 30 μm in the depth direction. In other words, for one sample, one surface-layer void measurement region is defined in each of seven Al alloy wires forming a strand wire to thereby define a total of seven surface-layer void measurement regions. Then, the total cross-sectional area of the voids existing in each surface-layer void measurement region is calculated. The total cross-sectional area of voids in the total seven surface-layer void measurement regions is checked for each sample. Tables 13 to 16 each show, as a total area A ($\mu m^2$), the value obtained by averaging the total cross-sectional areas of voids in the total seven measurement regions.

In place of the above-mentioned rectangular surface-layer void measurement region, a sector-shaped void measurement region having an area of 1500 $\mu m^2$ was defined in an annular surface layer region having a thickness of 30 μm. Then, in the same manner as with evaluation of the above-mentioned rectangular surface-layer void measurement region, a total area B ($\mu m^2$) of voids in the sector-shaped void measurement region was calculated. The results thereof are shown in Tables 13 to 16.

In the above-mentioned transverse section, an inside void measurement region in a shape of a rectangle having a short side length of 30 μm and a long side length of 50 μm is defined in each of the Al alloy wires forming a conductor. The inside void measurement region is defined such that the center of the rectangle coincides with the center of each Al alloy wire. Then, the ratio "inside/surface layer" of the total cross-sectional area of the voids existing in the inside void measurement region to the total cross-sectional area of the voids existing in the surface-layer void measurement region is calculated. The ratio "inside/surface layer" is calculated for the total seven surface-layer void measurement regions and inside void measurement regions for each sample. The value obtained by averaging the ratios "inside/surface layer" in the total seven measurement regions is shown as a ratio "inside/surface layer A" in Tables 13 to 16. In the same manner as with evaluation of the above-mentioned rectangular surface-layer void measurement region, the above-mentioned ratio "inside/surface layer B" in the case of the above-mentioned sector-shaped void measurement region is calculated, and the results thereof are shown in Tables 13 to 16.

Crystal Grain Size

Also, in the above-mentioned transverse section, on the basis of JIS G 0551 (Steels-Micrographic determination of the grain size, 2013), a test line is drawn in the SEM observation image and the length sectioning the test line in each crystal grain is defined as a crystal grain size (cutting method). The length of the test line is defined to such an extent that ten or more crystal grains are sectioned by this test line. Then, three test lines are drawn on one transverse section to calculate each crystal grain size. Then, the averaged value of these crystal grain sizes is shown as an average crystal grain size (pin) in Tables 13 to 16.

(Hydrogen Content)

From the covered electrical wire of each of the obtained samples, the insulation cover was removed to obtain a conductor alone. Then, the hydrogen content per conductor 100 g (ml/100 g) was measured. The results thereof are shown in Tables 13 to 16. The hydrogen content is measured by the inert gas fusion method. Specifically, a sample is introduced into a graphite crucible in an argon air flow and heated and melted, thereby extracting hydrogen together with other gas. The extracted gas is caused to flow through a separation column to separate hydrogen from other gas and measure the separated hydrogen by a heat conductivity detector to quantify the concentration of hydrogen, thereby calculating the hydrogen content.

(Surface Property)

Dynamic Friction Coefficient

Figure 5:
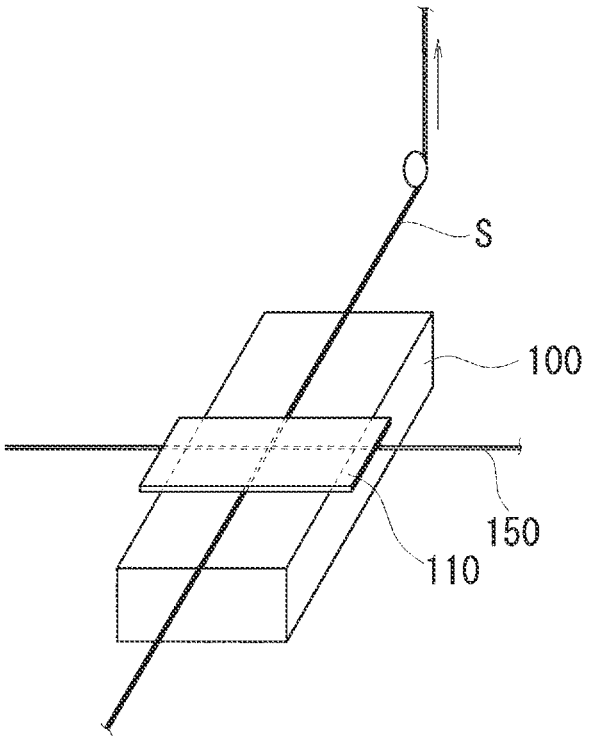
FIG. 5 is an explanatory diagram for illustrating a method of measuring a dynamic friction coefficient.

From the covered electrical wire of each of the obtained samples, the insulation cover was removed to obtain a conductor alone. Then, the strand wire or the compressed strand wire constituting the conductor was unbound into elemental wires. Each of the elemental wires (Al alloy wires) was employed as a sample to measure a dynamic friction coefficient in a below-described manner. Results are shown in Tables 17 to 20. As shown in FIG. 5, a mount 100 in a shape of a rectangular parallelepiped is prepared. An elemental wire (Al alloy wire) serving as a counterpart material 150 is laid on one rectangular surface of the surfaces of mount 100 in parallel with the short side direction of the rectangular surface. Both ends of counterpart material 150 are fixed (positions of fixation are not shown). An elemental wire (Al alloy wire) serving as a sample S is disposed horizontally on counterpart material 150 so as to be orthogonal to counterpart material 150 and in parallel with the long side direction of the above-mentioned one surface of mount 100. A weight 110 (here, 200 g) having a predetermined mass is disposed on a crossing position between sample S and counterpart material 150 such that the crossing position is not deviated. In this state, a pulley is disposed in the middle of sample S and one end of sample S is pulled upward along the pulley to measure tensile force (N) using an autograph or the like. An average load from the start of relative deviation movement of sample S and counterpart material 150 to a moment at which they are moved by 100 mm is defined as dynamical friction force (N). A value (dynamical friction force/normal force) obtained by dividing the dynamical friction force by normal force (2N in this case) generated by the mass of weight 110 is defined as a dynamic friction coefficient.

Surface Roughness

From the covered electrical wire of each of the obtained samples, the insulation cover was removed to obtain a conductor alone. Then, the strand wire or the compressed strand wire constituting the conductor was unraveled into elemental wires. Each of the elemental wires (Al alloy wires) was employed as a sample to measure a surface roughness (μm) using a commercially available three-dimensional optical profiler (for example, NewView7100 provided by ZYGO). Here, in each elemental wire (Al alloy wire), an arithmetic mean roughness Ra (μm) is calculated within a rectangular region of 85 μm×64 μm. For each sample, arithmetic mean roughness Ra in each of total seven regions is checked to obtain an average value of arithmetic mean roughnesses Ra in the total seven regions as a surface roughness (μm), which is shown in Table 17 to Table 20.

Amount of Adhesion of C

From the covered electrical wire of each of the obtained samples, the insulation cover was removed to obtain a conductor alone. Then, the strand wire or the compressed strand wire constituting the conductor was unraveled to check the amount of adhesion of C originated from the lubricant adhering to a surface of the central element wire. The amount of adhesion (mass %) of C was measured using a SEM-EDX (energy dispersive X-ray analysis) device with an acceleration voltage of an electron gun being set to 5 kV. The results are shown in Tables 13 to 16. It should be noted that in the case where the lubricant adheres to the surface of the Al alloy wire constituting the conductor included in the covered electrical wire, the lubricant may be removed together with the insulation cover at a position of contact with the insulation cover in the Al alloy wire when removing the insulation cover, with the result that the amount of adhesion of C may be unable to be measured appropriately. On the other hand, in the case where the amount of adhesion of C on the surface of the Al alloy wire constituting the conductor included in the covered electrical wire is measured, it is considered that the amount of adhesion of C can be precisely measured by measuring the amount of adhesion of C at a position of the Al alloy wire not in contact with the insulation cover. Thus, in this case, in the strand wire or compressed strand wire each including seven Al alloy wires stranded together with respect to the same center, the amount of adhesion of C is measured at the central element wire that is not in contact with the insulation cover. The amount of adhesion of C may be measured on an outer circumferential elemental wire, which surrounds the outer circumference of the central element wire, at its portion not in contact with the insulation cover.

Surface Oxide Film

From the covered electrical wire of each of the obtained samples, the insulation cover was removed to obtain a conductor alone. Then, the strand wire or the compressed strand wire constituting a conductor was unraveled into elemental wires. The surface oxide film of each elemental wire was measured as follows. In this case, the thickness of the surface oxide film of each elemental wire (Al alloy wire) is examined. The thickness of the surface oxide film in each of the total seven elemental wires is checked for each sample. Then, the averaged value of the thicknesses of the surface oxide films of the total seven elemental wires is shown as a thickness (nm) of the surface oxide film in Tables 17 to 20. Cross section polisher (CP) treatment is performed to define a cross section of each elemental wire. Then, the defined cross section is subjected to SEM observation. In the case of a relatively thick oxide film having a thickness exceeding about 50 nm, the thickness is measured using this SEM observation image. When a relatively thin oxide film having a thickness of equal to or less than about 50 nm is seen in the SEM observation, an analysis in the depth direction (repeating sputtering and an analysis by energy dispersive X-ray analysis (EDX)) is separately performed by X-ray photoelectron spectrometry (ESCA) for measurement.

(Impact Resistance)

For the covered electrical wire of each of the obtained samples, an impact resistance (J/m) was evaluated with reference to PTL 1. Schematically, a weight is attached to the end portion of the sample at the distance between evaluation points of 1 m. After the weight is raised upward by 1 m, the weight is caused to freely fall. Then, the largest mass (kg) of the weight with no disconnection occurring in the sample is measured. The value obtained by dividing the product value, which is obtained by multiplying the gravitational acceleration (9.8 $m/s^2$) and 1 m of falling distance by the mass of this weight, by the falling distance (1 m) is defined as an evaluation parameter (J/m or (N·m) of the impact resistance. The value obtained by dividing the obtained evaluation parameter of the impact resistance by the conductor cross-sectional area (0.75 $mm^2$ in this case) is shown in Tables 17 to 20 as an evaluation parameter ($J/m \cdot mm^2$) of the impact resistance per unit area.

(Terminal Fixing Force)

For the terminal-equipped electrical wire of each of the obtained samples, terminal fixing force (N) was evaluated with reference to PTL 1. Schematically, the terminal portion attached to one end of the terminal-equipped electrical wire is sandwiched by a terminal chuck to remove the insulation cover at the other end of the covered electrical wire, and then, the conductor portion is held by a conductor chuck. For the terminal-equipped electrical wire of each sample held at its both ends by both chucks, the maximum load (N) at the time of breakage is measured using a general-purpose tensile testing machine to evaluate the maximum load (N) as terminal fixing force (N). The value obtained by dividing the calculated maximum load by the conductor cross-sectional area (0.75 $mm^2$ in this case) is shown in Tables 17 to 20 as terminal fixing force per unit area ($N/mm^2$).

(Corrosion Resistance)

From the covered electrical wire of each of the obtained samples, the insulation cover was removed to obtain a conductor alone. The strand wire or the compressed strand wire constituting the conductor was unraveled into elemental wires, any one of which was employed as a sample, which was then subjected to a salt spray test so as to determine whether corrosion occurred or not by way of visual observation. The results thereof are shown in Table 21. The salt spray test is performed under the following conditions: 5 mass % concentration of a NaCl aqueous solution is used; and test time is 96 hours. Table 21 representatively shows: sample No. 1-5 in which the amount of adhesion of C is 8 mass %; sample No. 2-207 in which the amount of adhesion of C is 0 mass % and the lubricant does not substantially adhere; and sample No. 1-109 in which the amount of adhesion of C is 40 mass % and the lubricant adheres excessively. It should be noted that samples No. 1-1 to No. 1-23 excluding sample No. 1-5, and No. 2-1 to No. 2-23, and No. 3-1 to No. 3-12 exhibited results similar to that of sample No. 1-5.

TABLE 13

| | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Void | Void | Void | Void | Crystallized Material | | |
| Sample No. | Surface-Layer Total Area A [$\mu m^2$] | Surface-Layer Total Area B [$\mu m^2$] | Area Ratio Inside/Surface Layer A | Area Ratio Inside/Surface Layer B | Average Area A [$\mu m^2$] | Average Area B [$\mu m^2$] | Number A [Number of Pieces] |
| 1-1 | 1.4 | 1.4 | 5.2 | 5.3 | 1.4 | 1.4 | 25 |
| 1-2 | 0.8 | 0.8 | 1.1 | 1.1 | 0.1 | 0.1 | 23 |
| 1-3 | 1.8 | 1.8 | 2.5 | 2.5 | 0.7 | 0.6 | 98 |
| 1-4 | 1.4 | 1.4 | 1.1 | 1.1 | 0.3 | 0.4 | 147 |
| 1-5 | 1.7 | 1.6 | 5.2 | 5.1 | 1.5 | 1.6 | 197 |
| 1-6 | 1.8 | 1.9 | 3.8 | 3.9 | 1.1 | 1.1 | 330 |
| 1-7 | 0.9 | 0.9 | 1.6 | 1.6 | 0.4 | 0.5 | 308 |
| 1-8 | 0.8 | 0.8 | 3.1 | 3.2 | 0.9 | 0.9 | 248 |
| 1-9 | 1.4 | 1.4 | 6.5 | 6.3 | 1.8 | 1.7 | 59 |
| 1-10 | 0.3 | 0.2 | 1.3 | 1.3 | 0.3 | 0.3 | 116 |
| 1-11 | 1.5 | 1.5 | 1.3 | 1.2 | 0.3 | 0.4 | 67 |
| 1-12 | 1.4 | 1.5 | 5.5 | 5.6 | 1.5 | 1.5 | 125 |
| 1-13 | 0.5 | 0.5 | 4.8 | 4.6 | 1.3 | 1.4 | 53 |
| 1-14 | 1.2 | 1.2 | 4.6 | 4.5 | 1.2 | 1.3 | 90 |
| 1-15 | 1.9 | 2.0 | 2.7 | 2.6 | 0.7 | 0.7 | 58 |
| 1-16 | 1.9 | 2.0 | 2.8 | 2.7 | 0.8 | 0.8 | 77 |
| 1-17 | 0.6 | 0.6 | 2.2 | 2.2 | 0.6 | 0.7 | 101 |
| 1-18 | 1.0 | 1.0 | 4.6 | 4.4 | 1.2 | 1.2 | 166 |
| 1-19 | 0.7 | 0.7 | 1.1 | 1.1 | 0.1 | 0.1 | 104 |
| 1-20 | 1.6 | 1.5 | 5.0 | 4.8 | 1.3 | 1.4 | 212 |
| 1-21 | 1.5 | 1.5 | 11.0 | 11.0 | 2.9 | 2.9 | 151 |
| 1-22 | 0.5 | 0.4 | 2.5 | 2.6 | 0.7 | 0.7 | 195 |
| 1-23 | 1.4 | 1.4 | 4.8 | 5.0 | 1.3 | 1.2 | 312 |
| 1-101 | 0.8 | 0.7 | 6.1 | 6.0 | 1.7 | 1.8 | 8 |
| 1-102 | 0.6 | 0.5 | 2.6 | 2.6 | 0.7 | 0.6 | 10 |
| 1-103 | 0.8 | 0.8 | 4.1 | 4.2 | 1.1 | 1.2 | 576 |
| 1-104 | 0.9 | 0.8 | 3.7 | 3.5 | 1.1 | 1.0 | 521 |

TABLE 13-continued

| | 0.75 sq (Strand Wire Formed of 7 Members of φ 0.37 mm or Compressed Strand Wire Formed of 7 Members of φ 0.39 mm) | | | | | |
|---|---|---|---|---|---|---|
| | Crystallized Material | | | | | |
| Sample No. | Number B [Number of Pieces] | Area Ratio A [%] | Area Ratio B [%] | Average Crystal Grain Size [μm] | Hydrogen Concentration [ml/100 g] | Amount of C [Mass %] |
| 1-1 | 29 | 89 | 90 | 5 | 3.4 | 10 |
| 1-2 | 27 | 100 | 99 | 13 | 1.1 | 8 |
| 1-3 | 93 | 95 | 96 | 6 | 3.3 | 9 |
| 1-4 | 158 | 99 | 98 | 6 | 2.1 | 9 |
| 1-5 | 197 | 89 | 90 | 4 | 3.5 | 8 |
| 1-6 | 338 | 92 | 92 | 1 | 2.9 | 7 |
| 1-7 | 299 | 97 | 98 | 25 | 1.6 | 15 |
| 1-8 | 242 | 94 | 93 | 7 | 0.9 | 7 |
| 1-9 | 64 | 86 | 85 | 20 | 2.4 | 4 |
| 1-10 | 114 | 98 | 97 | 5 | 0.3 | 13 |
| 1-11 | 56 | 98 | 99 | 11 | 3.1 | 9 |
| 1-12 | 128 | 89 | 87 | 17 | 3.4 | 2 |
| 1-13 | 59 | 90 | 89 | 28 | 0.8 | 4 |
| 1-14 | 91 | 91 | 88 | 15 | 2.3 | 5 |
| 1-15 | 54 | 95 | 95 | 48 | 3.7 | 9 |
| 1-16 | 74 | 95 | 96 | 19 | 3.4 | 3 |
| 1-17 | 97 | 96 | 93 | 9 | 0.7 | 13 |
| 1-18 | 162 | 91 | 91 | 16 | 1.6 | 8 |
| 1-19 | 107 | 100 | 99 | 2 | 1.3 | 6 |
| 1-20 | 216 | 90 | 89 | 34 | 2.3 | 30 |
| 1-21 | 142 | 76 | 74 | 4 | 3.2 | 9 |
| 1-22 | 194 | 95 | 97 | 17 | 0.4 | 15 |
| 1-23 | 324 | 90 | 90 | 16 | 2.7 | 2 |
| 1-101 | 8 | 87 | 86 | 17 | 1.5 | 7 |
| 1-102 | 9 | 95 | 96 | 6 | 0.8 | 8 |
| 1-103 | 559 | 92 | 94 | 3 | 1.6 | 5 |
| 1-104 | 548 | 93 | 91 | 3 | 1.5 | 5 |

TABLE 14

| | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Void | Void | Void | Void | Crystallized Material | | |
| Sample No. | Surface-Layer Total Area A [$\mu m^2$] | Surface-Layer Total Area B [$\mu m^2$] | Area Ratio Inside/Surface Layer A | Area Ratio Inside/Surface Layer B | Average Area A [$\mu m^2$] | Average Area B [$\mu m^2$] | Number A [Number of Pieces] |
| 2-1 | 1.3 | 1.2 | 4.1 | 3.9 | 1.1 | 1.2 | 99 |
| 2-2 | 1.9 | 1.8 | 3.0 | 2.9 | 0.8 | 0.8 | 57 |
| 2-3 | 1.1 | 1.1 | 1.1 | 1.1 | 0.3 | 0.4 | 144 |
| 2-4 | 2.0 | 2.1 | 3.5 | 3.4 | 1.0 | 0.9 | 120 |
| 2-5 | 1.0 | 1.0 | 5.8 | 5.7 | 1.6 | 1.6 | 120 |
| 2-6 | 0.5 | 0.6 | 1.8 | 1.9 | 0.6 | 0.5 | 164 |
| 2-7 | 0.8 | 0.8 | 2.2 | 2.3 | 0.6 | 0.5 | 226 |
| 2-8 | 1.6 | 1.6 | 4.6 | 4.6 | 1.2 | 1.1 | 392 |
| 2-9 | 1.3 | 1.3 | 3.1 | 3.2 | 0.8 | 0.8 | 125 |
| 2-10 | 0.9 | 0.9 | 6.9 | 7.1 | 1.8 | 1.7 | 242 |
| 2-11 | 0.7 | 0.8 | 3.3 | 3.3 | 0.9 | 0.9 | 225 |
| 2-12 | 0.3 | 0.4 | 4.6 | 4.6 | 1.2 | 1.3 | 133 |
| 2-13 | 0.2 | 0.3 | 1.2 | 1.2 | 0.1 | 0.1 | 189 |
| 2-14 | 1.3 | 1.2 | 3.4 | 3.5 | 0.9 | 1.0 | 156 |
| 2-15 | 1.4 | 1.3 | 5.8 | 5.8 | 1.5 | 1.6 | 172 |
| 2-16 | 1.9 | 1.8 | 6.9 | 6.6 | 1.8 | 1.7 | 183 |
| 2-17 | 0.5 | 0.5 | 2.6 | 2.4 | 0.7 | 0.7 | 124 |
| 2-18 | 0.4 | 0.3 | 4.8 | 5.0 | 1.2 | 1.3 | 204 |
| 2-19 | 1.7 | 1.7 | 7.9 | 7.8 | 2.3 | 2.4 | 179 |
| 2-20 | 1.1 | 1.0 | 1.4 | 1.4 | 0.4 | 0.4 | 228 |
| 2-21 | 0.7 | 0.8 | 2.0 | 1.9 | 0.5 | 0.5 | 183 |
| 2-22 | 0.6 | 0.7 | 1.1 | 1.1 | 0.2 | 0.1 | 165 |
| 2-23 | 1.2 | 1.1 | 5.0 | 4.9 | 1.4 | 1.5 | 142 |
| 2-201 | 1.9 | 1.8 | 6.1 | 6.1 | 1.7 | 1.6 | 782 |
| 2-202 | 0.7 | 0.7 | 1.0 | 1.0 | 0.3 | 0.4 | 196 |

TABLE 14-continued

| | 0.75 sq (Strand Wire Formed of 7 Members of φ 0.37 mm or Compressed Strand Wire Formed of 7 Members of φ 0.39 mm) | | | | | |
|---|---|---|---|---|---|---|
| | Crystallized Material | | | | | |
| Sample No. | Number B [Number of Pieces] | Area Ratio A [%] | Area Ratio B [%] | Average Crystal Grain Size [μm] | Hydrogen Concentration [ml/100 g] | Amount of C [Mass %] |
| 2-1 | 95 | 92 | 92 | 19 | 2.6 | 4 |
| 2-2 | 52 | 94 | 95 | 37 | 2.9 | 3 |
| 2-3 | 139 | 98 | 99 | 24 | 2.4 | 6 |
| 2-4 | 110 | 93 | 94 | 12 | 4.0 | 10 |
| 2-5 | 117 | 88 | 86 | 6 | 2.1 | 4 |
| 2-6 | 166 | 97 | 95 | 3 | 0.4 | 10 |
| 2-7 | 221 | 96 | 96 | 15 | 0.9 | 10 |
| 2-8 | 375 | 91 | 89 | 22 | 3.6 | 1 |
| 2-9 | 110 | 94 | 95 | 19 | 2.3 | 13 |
| 2-10 | 235 | 85 | 83 | 8 | 1.1 | 7 |
| 2-11 | 214 | 93 | 95 | 12 | 1.2 | 10 |
| 2-12 | 125 | 91 | 88 | 2 | 0.4 | 6 |
| 2-13 | 186 | 100 | 100 | 18 | 0.2 | 3 |
| 2-14 | 149 | 93 | 94 | 16 | 2.5 | 7 |
| 2-15 | 164 | 88 | 88 | 12 | 2.0 | 10 |
| 2-16 | 194 | 85 | 85 | 12 | 2.9 | 5 |
| 2-17 | 115 | 95 | 96 | 13 | 0.7 | 6 |
| 2-18 | 190 | 90 | 89 | 2 | 0.3 | 5 |
| 2-19 | 167 | 83 | 83 | 27 | 3.6 | 12 |
| 2-20 | 217 | 98 | 98 | 2 | 1.8 | 5 |
| 2-21 | 174 | 97 | 96 | 19 | 1.3 | 9 |
| 2-22 | 164 | 100 | 98 | 20 | 1.1 | 6 |
| 2-23 | 154 | 90 | 90 | 17 | 2.8 | 10 |
| 2-201 | 756 | 87 | 89 | 13 | 3.7 | 7 |
| 2-202 | 203 | 99 | 98 | 10 | 0.7 | 17 |

TABLE 15

| | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Void | Void | Void | Void | Crystallized Material | | |
| Sample No. | Surface-Layer Total Area A [μm$^2$] | Surface-Layer Total Area B [μm$^2$] | Area Ratio Inside/Surface Layer A | Area Ratio Inside/Surface Layer B | Average Area A [μm$^2$] | Average Area B [μm$^2$] | Number A [Number of Pieces] |
| 3-1 | 1.0 | 0.9 | 4.8 | 4.9 | 1.3 | 1.4 | 23 |
| 3-2 | 0.8 | 0.7 | 1.9 | 1.9 | 0.5 | 0.6 | 77 |
| 3-3 | 0.7 | 0.6 | 2.5 | 2.5 | 0.7 | 0.7 | 210 |
| 3-4 | 1.2 | 1.1 | 6.9 | 6.9 | 1.9 | 1.9 | 319 |
| 3-5 | 1.9 | 1.9 | 5.8 | 5.6 | 1.7 | 1.7 | 385 |
| 3-6 | 1.1 | 1.0 | 5.5 | 5.4 | 1.6 | 1.5 | 55 |
| 3-7 | 1.0 | 0.9 | 5.5 | 5.6 | 1.5 | 1.5 | 80 |
| 3-8 | 1.9 | 1.9 | 6.9 | 6.7 | 1.8 | 1.8 | 159 |
| 3-9 | 0.8 | 0.8 | 2.0 | 1.9 | 0.6 | 0.5 | 119 |
| 3-10 | 1.3 | 1.3 | 4.6 | 4.7 | 1.3 | 1.3 | 69 |
| 3-11 | 0.8 | 0.7 | 1.1 | 1.1 | 0.2 | 0.2 | 60 |
| 3-12 | 0.5 | 0.6 | 4.6 | 4.7 | 1.3 | 1.2 | 116 |
| 3-301 | 0.7 | 0.7 | 5.5 | 5.4 | 1.6 | 1.7 | 551 |
| 3-302 | 0.3 | 0.2 | 3.2 | 3.2 | 0.9 | 0.8 | 355 |

| | 0.75 sq (Strand Wire Formed of 7 Members of φ 0.37 mm or Compressed Strand Wire Formed of 7 Members of φ 0.39 mm) | | | | | |
|---|---|---|---|---|---|---|
| | Crystallized Material | | | | | |
| Sample No. | Number B [Number of Pieces] | Area Ratio A [%] | Area Ratio B [%] | Average Crystal Grain Size [μm] | Hydrogen Concentration [ml/100 g] | Amount of C [Mass %] |
| 3-1 | 26 | 90 | 91 | 17 | 1.5 | 6 |
| 3-2 | 70 | 97 | 99 | 6 | 1.0 | 9 |
| 3-3 | 215 | 95 | 94 | 32 | 1.1 | 7 |
| 3-4 | 331 | 85 | 85 | 18 | 2.3 | 1 |
| 3-5 | 378 | 88 | 86 | 13 | 3.3 | 3 |
| 3-6 | 54 | 89 | 88 | 29 | 1.4 | 9 |
| 3-7 | 76 | 89 | 90 | 17 | 1.5 | 5 |
| 3-8 | 168 | 85 | 83 | 5 | 3.3 | 6 |
| 3-9 | 118 | 96 | 95 | 7 | 1.6 | 15 |

TABLE 15-continued

| | | | | | | |
|---|---|---|---|---|---|---|
| 3-10 | 79 | 91 | 93 | 12 | 2.1 | 5 |
| 3-11 | 49 | 100 | 98 | 17 | 1.1 | 6 |
| 3-12 | 124 | 91 | 91 | 3 | 0.9 | 9 |
| 3-301 | 572 | 89 | 89 | 2 | 1.4 | 5 |
| 3-302 | 341 | 94 | 95 | 13 | 0.3 | 7 |

TABLE 16

| | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Void | Void | Void | Void | Crystallized Material | | |
| Sample No. | Surface-Layer Total Area A [μm$^2$] | Surface-Layer Total Area B [μm$^2$] | Area Ratio Inside/Surface Layer A | Area Ratio Inside/Surface Layer B | Average Area A [μm$^2$] | Average Area B [μm$^2$] | Number A [Number of Pieces] |
| 1-105 | 4.8 | 4.8 | 5.5 | 5.7 | 1.5 | 1.4 | 185 |
| 1-106 | 2.1 | 2.1 | 1.5 | 1.4 | 1.2 | 1.1 | 145 |
| 1-107 | 1.8 | 1.7 | 22.0 | 22.1 | 4.2 | 4.2 | 70 |
| 1-108 | 1.9 | 1.9 | 5.1 | 4.9 | 1.7 | 1.8 | 187 |
| 1-109 | 1.6 | 1.7 | 5.2 | 5.3 | 1.6 | 1.6 | 189 |
| 2-204 | 1.1 | 1.0 | 6.5 | 6.4 | 1.7 | 1.8 | 109 |
| 2-205 | 4.5 | 4.5 | 45.0 | 45.0 | 1.6 | 1.7 | 124 |
| 2-206 | 1.1 | 1.0 | 35.0 | 35.1 | 5.6 | 5.6 | 70 |
| 2-207 | 1.2 | 1.2 | 6.1 | 6.3 | 1.7 | 1.6 | 124 |
| 2-208 | 1.0 | 1.0 | 6.1 | 6.1 | 1.6 | 1.7 | 120 |
| 2-209 | 1.1 | 1.1 | 5.2 | 5.2 | 1.5 | 1.5 | 104 |
| 3-305 | 5.5 | 5.5 | 2.4 | 2.3 | 0.7 | 0.6 | 198 |
| 3-306 | 0.8 | 0.8 | 18.0 | 17.9 | 3.7 | 3.7 | 142 |
| 3-307 | 0.8 | 0.8 | 2.7 | 2.7 | 0.8 | 0.8 | 198 |

| | 0.75 sq (Strand Wire Formed of 7 Members of φ 0.37 mm or Compressed Strand Wire Formed of 7 Members of φ 0.39 mm) | | | | | |
|---|---|---|---|---|---|---|
| | Crystallized Material | | | | | |
| Sample No. | Number B [Number of Pieces] | Area Ratio A [%] | Area Ratio B [%] | Average Crystal Grain Size [μm] | Hydrogen Concentration [ml/100 g] | Amount of C [Mass %] |
| 1-105 | 179 | 89 | 89 | 5 | 6.5 | 7 |
| 1-106 | 145 | 87 | 87 | 5 | 4.2 | 8 |
| 1-107 | 67 | 51 | 50 | 4 | 3.7 | 8 |
| 1-108 | 195 | 89 | 89 | 5 | 3.7 | 0 |
| 1-109 | 198 | 89 | 88 | 4 | 3.6 | 40 |
| 2-204 | 105 | 86 | 84 | 84 | 2.4 | 5 |
| 2-205 | 128 | 89 | 90 | 5 | 7.2 | 5 |
| 2-206 | 75 | 43 | 41 | 6 | 2.2 | 4 |
| 2-207 | 133 | 87 | 88 | 7 | 2.5 | 0 |
| 2-208 | 122 | 87 | 86 | 6 | 2.1 | 4 |
| 2-209 | 107 | 89 | 89 | 9 | 1.4 | 9 |
| 3-305 | 200 | 94 | 96 | 33 | 6.8 | 6 |
| 3-306 | 149 | 56 | 56 | 32 | 1.2 | 8 |
| 3-307 | 198 | 95 | 94 | 31 | 1.7 | 8 |

TABLE 17

| | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| Sample No. | Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
| 1-1 | 1.39 | 0.1 | 51 | 12 | 16 | 58 | 78 |
| 1-2 | 1.09 | 0.1 | 42 | 12 | 17 | 60 | 80 |
| 1-3 | 0.97 | 0.1 | 30 | 15 | 19 | 63 | 84 |
| 1-4 | 0.81 | 0.1 | 103 | 18 | 23 | 63 | 84 |
| 1-5 | 1.70 | 0.1 | 55 | 17 | 23 | 64 | 86 |
| 1-6 | 1.93 | 0.2 | 27 | 16 | 21 | 76 | 102 |

TABLE 17-continued

| Sample No. | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
| 1-7 | 1.51 | 0.1 | 110 | 14 | 18 | 69 | 92 |
| 1-8 | 0.54 | 0.1 | 18 | 10 | 13 | 77 | 102 |
| 1-9 | 0.86 | 0.2 | 19 | 13 | 18 | 62 | 82 |
| 1-10 | 1.69 | 0.1 | 111 | 10 | 13 | 68 | 91 |
| 1-11 | 0.93 | 0.1 | 60 | 12 | 16 | 62 | 83 |
| 1-12 | 1.59 | 0.5 | 41 | 13 | 17 | 71 | 94 |
| 1-13 | 1.09 | 0.2 | 108 | 14 | 18 | 62 | 83 |
| 1-14 | 1.28 | 0.2 | 5 | 12 | 16 | 66 | 88 |
| 1-15 | 1.70 | 0.1 | 82 | 10 | 14 | 68 | 91 |
| 1-16 | 1.87 | 0.5 | 6 | 16 | 22 | 77 | 103 |
| 1-17 | 0.93 | 0.1 | 95 | 13 | 17 | 66 | 88 |
| 1-18 | 1.42 | 0.1 | 10 | 17 | 22 | 65 | 86 |
| 1-19 | 1.00 | 0.1 | 41 | 12 | 15 | 65 | 87 |
| 1-20 | 0.85 | 0.1 | 69 | 16 | 21 | 69 | 92 |
| 1-21 | 0.99 | 0.1 | 27 | 16 | 21 | 64 | 86 |
| 1-22 | 1.11 | 0.1 | 111 | 18 | 23 | 73 | 98 |
| 1-23 | 1.64 | 0.5 | 19 | 11 | 15 | 71 | 95 |
| 1-101 | 0.76 | 0.1 | 34 | 5 | 7 | 60 | 79 |
| 1-102 | 0.88 | 0.1 | 19 | 7 | 10 | 38 | 51 |
| 1-103 | 1.01 | 0.2 | 13 | 11 | 15 | 61 | 81 |
| 1-104 | 1.08 | 0.2 | 15 | 9 | 12 | 76 | 101 |

TABLE 18

| Sample No. | 0.75 sq (Strand Wire Formed of 7 Members of φ 0.37 mm or Compressed Strand Wire Formed of 7 Members of φ 0.39 mm) | | | | | | |
|---|---|---|---|---|---|---|---|
| | Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
| 2-1 | 1.48 | 0.3 | 13 | 17 | 23 | 67 | 89 |
| 2-2 | 1.78 | 0.4 | 21 | 10 | 13 | 66 | 88 |
| 2-3 | 0.56 | 0.1 | 41 | 13 | 17 | 69 | 92 |
| 2-4 | 0.69 | 0.1 | 120 | 13 | 18 | 70 | 93 |
| 2-5 | 0.69 | 0.1 | 31 | 13 | 18 | 69 | 93 |
| 2-6 | 0.03 | 0.1 | 5 | 15 | 20 | 68 | 91 |
| 2-7 | 0.70 | 0.1 | 15 | 10 | 13 | 73 | 97 |
| 2-8 | 1.11 | 0.8 | 1 | 14 | 19 | 71 | 95 |
| 2-9 | 1.93 | 0.1 | 103 | 13 | 17 | 70 | 94 |
| 2-10 | 0.03 | 0.1 | 49 | 12 | 16 | 68 | 91 |
| 2-11 | 0.60 | 0.1 | 61 | 13 | 18 | 68 | 91 |
| 2-12 | 1.22 | 0.1 | 11 | 12 | 16 | 70 | 94 |
| 2-13 | 0.78 | 0.2 | 10 | 15 | 20 | 67 | 90 |
| 2-14 | 0.67 | 0.1 | 46 | 11 | 15 | 71 | 95 |
| 2-15 | 1.69 | 0.1 | 10 | 14 | 18 | 69 | 92 |
| 2-16 | 1.29 | 0.2 | 5 | 15 | 20 | 73 | 97 |
| 2-17 | 1.94 | 0.2 | 19 | 13 | 17 | 70 | 93 |
| 2-18 | 1.47 | 0.2 | 13 | 14 | 18 | 74 | 99 |
| 2-19 | 0.69 | 0.1 | 106 | 14 | 18 | 67 | 90 |
| 2-20 | 1.54 | 0.2 | 39 | 13 | 17 | 71 | 95 |
| 2-21 | 0.66 | 0.1 | 115 | 14 | 19 | 68 | 90 |
| 2-22 | 1.78 | 0.2 | 23 | 10 | 13 | 85 | 114 |
| 2-23 | 1.36 | 0.1 | 10 | 12 | 16 | 71 | 94 |
| 2-201 | 0.62 | 0.1 | 10 | 5 | 7 | 98 | 131 |
| 2-202 | 1.06 | 0.1 | 6 | 2 | 3 | 130 | 173 |

TABLE 19

| Sample No. | 0.75 sq (Strand Wire Formed of 7 Members of φ 0.37 mm or Compressed Strand Wire Formed of 7 Members of φ 0.39 mm) Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
|---|---|---|---|---|---|---|---|
| 3-1 | 1.78 | 0.2 | 28 | 11 | 15 | 63 | 84 |
| 3-2 | 1.40 | 0.1 | 111 | 10 | 13 | 86 | 115 |
| 3-3 | 0.63 | 0.1 | 21 | 16 | 21 | 68 | 90 |
| 3-4 | 0.90 | 0.5 | 97 | 15 | 21 | 77 | 103 |
| 3-5 | 1.80 | 0.5 | 43 | 16 | 21 | 76 | 101 |
| 3-6 | 0.77 | 0.1 | 12 | 10 | 13 | 66 | 89 |
| 3-7 | 1.63 | 0.3 | 47 | 11 | 15 | 68 | 91 |
| 3-8 | 1.36 | 0.2 | 98 | 15 | 20 | 65 | 87 |
| 3-9 | 1.49 | 0.1 | 47 | 15 | 19 | 66 | 88 |
| 3-10 | 2.87 | 0.4 | 10 | 10 | 13 | 66 | 88 |
| 3-11 | 1.57 | 0.2 | 10 | 11 | 15 | 69 | 91 |
| 3-12 | 1.61 | 0.1 | 72 | 11 | 15 | 71 | 95 |
| 3-301 | 0.98 | 0.1 | 9 | 7 | 10 | 103 | 137 |
| 3-302 | 0.90 | 0.1 | 18 | 5 | 6 | 72 | 96 |

TABLE 20

| Sample No. | 0.75 sq (Strand Wire Formed of 7 Members of φ 0.37 mm or Compressed Strand Wire Formed of 7 Members of φ 0.39 mm) Surface Roughness [μm] | Dynamic Friction Coefficient (Elemental Wire) | Oxide Film Thickness [nm] | Impact Resistance [J/m] | Impact Resistance Unit Area [J/m · mm$^2$] | Terminal Fixing Force [N] | Terminal Fixing Force Unit Area [N/mm$^2$] |
|---|---|---|---|---|---|---|---|
| 1-105 | 1.75 | 0.1 | 60 | 14 | 18 | 61 | 81 |
| 1-106 | 1.68 | 0.4 | 45 | 15 | 20 | 62 | 83 |
| 1-107 | 1.68 | 0.1 | 52 | 16 | 21 | 62 | 83 |
| 1-108 | 1.64 | 1.1 | 45 | 16 | 21 | 62 | 83 |
| 1-109 | 1.59 | 0.1 | 30 | 8 | 11 | 38 | 51 |
| 2-204 | 0.62 | 0.1 | 29 | 11 | 15 | 66 | 88 |
| 2-205 | 0.68 | 0.1 | 28 | 9 | 12 | 65 | 87 |
| 2-206 | 0.70 | 0.1 | 30 | 12 | 16 | 67 | 89 |
| 2-207 | 0.73 | 0.5 | 42 | 12 | 16 | 70 | 93 |
| 2-208 | 3.48 | 1.0 | 31 | 10 | 13 | 65 | 87 |
| 2-209 | 0.54 | 0.3 | 250 | 13 | 18 | 53 | 71 |
| 3-305 | 0.65 | 0.1 | 25 | 12 | 16 | 64 | 85 |
| 3-306 | 0.62 | 0.1 | 24 | 15 | 20 | 67 | 89 |
| 3-307 | 4.23 | 0.9 | 35 | 16 | 21 | 65 | 87 |

TABLE 21

| Sample No. | Amount of C [Mass %] | Occurrence of Corrosion After Salt Spray Test (5% NaCl × 96 H) |
|---|---|---|
| 1-5 | 8 | Not Occurred |
| 2-207 | 0 | Occurred |
| 1-109 | 40 | Not Occurred |

Al alloy wires of samples No. 1-1 to No. 1-23, and No. 2-1 to No. 2-23, and No. 3-1 to No. 3-12 each formed of an Al—Fe-based alloy having a specific composition containing Fe in a specific range and containing specific elements (Mg, Si, Cu, Element α) as appropriate in specific ranges and each subjected to softening treatment (which may be hereinafter collectively referred to as a softened member sample group) each have a high evaluation parameter value of the impact resistance as high as 10 J/m or more, as shown in Tables 17 to 19, as compared with Al alloy wires of samples No. 1-101 to No. 1-104, No. 2-201, and No. 3-301 (which may be hereinafter collectively referred to as a comparison sample group) each having a composition other than the above-mentioned specific compositions. Also, the Al alloy wires in the softened member sample group also have excellent strength and the higher number of times of bending, as shown in Tables 9 to 11. This shows that the Al alloy wires in the softened member sample group have excellent impact resistance and excellent fatigue characteristics in a well-balanced manner as compared with the Al alloy wires in the comparison sample group. Furthermore, the Al alloy wires in the softened member sample group are excellent in mechanical characteristics and electrical characteristics, that is, have high tensile strength and high breaking elongation, and also have high 0.2% proof stress and high electrical conductivity. Quantitatively, the Al alloy wires in the softened member sample group satisfy the conditions of: tensile strength equal to or more than 110 MPa and equal to or less than 200 MPa; 0.2% proof stress equal to or more than 40 MPa (in this case, equal to or more than 45 MPa, and in most of the samples, equal to or more than 50 MPa); breaking elongation equal to or more than 10% (in this case, equal to or more than 11%, and in most of the samples, equal to or more than 15% and equal to or more than 20%); and electrical conductivity equal to or more than 55% IACS (in most of the samples, equal to or more than 57% IACS, and equal to or more than 58% IACS). In addition, the Al alloy wires in the softened member sample group show a high ratio "proof stress/tensile" between the tensile strength and the 0.2% proof stress, which is equal to or more than 0.4. Furthermore, it turns out that the Al alloy wires in the softened member sample group are excellent in performance of fixation to the terminal portion as shown in Tables 17 to 19 (equal to or more than 40N). As one of the reasons, it is considered that this is because the Al alloy wires in the softened member sample group each have a high work hardening exponent equal to or more than 0.05 (in most of the samples, equal to or more than 0.07, and further, equal to or more than 0.10; Tables 9 to 11), thereby excellently achieving the strength improving effect by work hardening during pressure-bonding of a crimp terminal.

The features regarding crystallized materials described below and the features regarding voids described later will be found by reference to the evaluation results obtained using a rectangular measurement region A and the evaluation results obtained using a sector-shaped measurement region B.

As shown in Tables 13 to 15, in each of the Al alloy wires in the softened member sample group, there is a certain amount of fine crystallized materials in the surface layer. Quantitatively, the average area of the crystallized materials is equal to or less than 3 $\mu m^2$. In many samples, the average area of the crystallized materials is equal to or less than 2 $\mu m^2$, is equal to or less than 1.5 $\mu m^2$ or is equal to or less than 1.0 $\mu m^2$. Moreover, the number of such fine crystallized materials is more than 10 and equal to or less than 400, and in this case, equal to or less than 350. In many samples, the number of such fine crystallized materials is equal to or less than 300, and in some samples, the number of such fine crystallized materials is equal to or less than 200 or equal to or less than 100. In comparison between sample No. 1-5 (Table 9, Table 17) and sample No. 1-107 (Table 12, Table 20) having the same composition, comparison between sample No. 2-5 (Table 10, Table 18) and sample No. 2-206 (Table 12, Table 20) having the same composition, and comparison between sample No. 3-3 (Table 11, Table 19) and sample No. 3-306 (Table 12, Table 20) having the same composition, the number of times of performing bending is larger and the parameter value of the impact resistance is higher in each of samples No. 1-5, No. 2-5, and No. 3-3 in each of which a certain amount of fine crystallized materials exists in the surface layer. In view of this, it is considered that the crystallized materials in the surface layer are fine and are therefore less likely to be origins of cracking, thereby leading to excellent impact resistance and fatigue characteristics. It is considered that existence of a certain amount of fine crystallized materials serves to suppress crystal growth and facilitate bending or the like, thus resulting in one factor of improvement in fatigue characteristics.

Based on the above-described test, in order to allow finely-grained crystallized materials and also allow a certain amount of such finely-grained crystallized materials to exist, it can be said that it is effective to set the cooling rate in the specific temperature range to be increased to some extent (in this case, more than 0.5° C./second, further, equal to or more than 1° C./second and equal to or less than 30° C./second, preferably, less than 25° C./second, and further, less than 20° C./second).

Furthermore, the following can be found from the above-mentioned test.

(1) As shown in "Area Ratio" in Tables 13 to 15, most (in this case, 70% or more, in most of the cases, 80% or more, and further, 85% or more) of the crystallized materials existing in the surface layer are equal to or less than 3 $\mu m^2$ and are finely grained and uniformly sized, and therefore, considered as being less likely to become origins of cracking.

Also based on this test, it is considered that small (equal to or less than 40 $\mu m^2$) crystallized materials existing not only in the surface layer but also inside thereof as described above can consequently suppress that the crystallized materials become origins of cracking and also that cracking progresses from the surface layer toward the inside thereof through these crystallized materials, thereby leading to excellent impact resistance and fatigue characteristics.

(2) As shown in Tables 13 to 15, in the Al alloy wires in the softened member sample group, the total area of voids existing in the surface layer is equal to or less than 2.0 $\mu m^2$, which is smaller than those of the Al alloy wires in sample No. 1-105, No. 2-205, and No. 3-305 in Table 16. Focusing an attention on these voids in the surface layer, the samples having the same composition (No. 1-5, No. 1-105), (No. 2-5, No. 2-205), and (No. 3-3, No. 3-305) are compared with one another. It turns out that sample No. 1-5 with the smaller amount of voids is more excellent in impact resistance (Tables 17 and 20), and also greater in number of times of bending and more excellent in fatigue characteristics (Tables 9 and 12). The same also applies to samples No. 2-5 and No. 3-3 each containing a smaller amount of voids. As one of the reasons, it is considered that this is because, in the Al alloy wires of samples No. 1-105, No. 2-205, and No. 3-305 each containing a large amount of voids in the surface layer, breakage is more likely to occur due to voids as origins of cracking upon an impact or repeated bending. Based on this, it can be recognized that the impact resistance and the fatigue characteristics can be improved by reducing the voids in the surface layer of the Al alloy wire. Also as shown in Tables 13 to 15, the Al alloy wires in the softened member sample group are smaller in hydrogen content than the Al alloy wires in samples No. 1-105, No. 2-205, and No. 3-305 shown in Table 16. Based on the above, one factor of voids is considered as hydrogen. It is considered that, in samples No. 1-105, No. 2-205, and No. 3-305, the temperature of melt is relatively high, and a large quantity of dissolved gas is more likely to exist in the melt. It is also considered that hydrogen derived from this dissolved gas has increased. Based on the above, it can be recognized as being effective to set the temperature of melt to be relatively low (less than 750° C. in this case) in the casting process in order to reduce the voids in the above-mentioned surface layer.

In addition, by the comparison between sample No. 1-3 and sample No. 1-10 (Table 13) and the comparison between sample No. 1-5 and sample No. 3-3 (Table 15), it turns out that hydrogen is readily reduced when Si and Cu are contained.

As shown in Tables 13 to 15, the Al alloy wires in the softened member sample group each contain a small amount of voids not only in the surface layer but also inside thereof. Quantitatively, the ratio "inside/surface layer" of the total area of voids is equal to or less than 44, and in this case, equal to or less than 20, and further, equal to or less than 15, and in most of the samples, equal to or less than 10, which are smaller than that of sample No. 2-205 (Table 16). When comparing sample No. 1-5 and sample No. 1-107 having the same composition, sample No. 1-5 with a smaller ratio "inside/surface layer" is higher in number of times of bending (Tables 9 and 12) and higher in parameter value of impact resistance (Tables 17 and 20) than sample No. 1-107. As one of the reasons, it is considered that, in the Al alloy wire of sample No. 1-107 containing a relatively large amount of inside voids, cracking progresses through voids from the surface layer toward the inside thereof upon an impact or repeated bending, so that breakage is more likely to occur. In the case of sample No. 2-205, the number of times of bending is small (Table 12) and the parameter value of impact resistance is low (Table 20). Accordingly, it can be said that the higher ratio "inside/surface layer" is more likely to cause cracking to progress toward inside, so that breakage is more likely to occur. Based on the above, it can be said that the impact resistance and the fatigue characteristics can be improved by reducing voids in the surface layer of the Al alloy wire and inside thereof. Furthermore, it can be said based on this test that the higher cooling rate is more likely to lead to a smaller ratio "inside/surface layer". Thus, in order to reduce the above-mentioned inside voids, it can be recognized as being effective to set the temperature of melt to be relatively low in the casting process and also to increase the cooling rate in the temperature range up to 650° C. to some extent (in this case, more than 0.5° C./second, and further, equal to or more than 1° C./second and equal to or less than 30° C./second, and preferably less than 25° C./second, and further, less than 20° C./second).

(3) As shown in Tables 17 to 19, the Al alloy wires in the softened member sample group each have a small dynamic friction coefficient. Quantitatively, the dynamic friction coefficient is equal to or less than 0.8, and in many of the samples, is equal to or less than 0.5. It is considered that due to such a small dynamic friction coefficient, the elemental wires forming the strand wire are more likely to slide on one another, so that disconnection is less likely to occur upon repeated bending. Then, for each of a solid wire (having a wire diameter of 0.3 mm) having the composition of sample No. 2-5 and a strand wire produced using Al alloy wires each having the composition of sample No. 2-5, the number of times of bending until occurrence of breakage was checked using the above-described repeated bending test machine. Test conditions are as follows: bending distortion is 0.9%; and load is 12.2 MPa. Elemental wires each having a wire diameter of φ 0.4 mm are prepared in the same manner as in a single Al alloy wire having a wire diameter of φ 0.3 mm. Then, sixteen elemental wires are stranded and then compressed, thereby obtaining a compressed strand wire having a cross-sectional area of 1.25 $mm^2$ (1.25 sq). Then, the compressed strand wire is subjected to softening treatment (conditions of sample No. 2-5 in Table 6). As a result of the test, the number of times of bending of the solid wire until occurrence of breakage was 1268, whereas the number of times of bending of the strand wire until occurrence of breakage was 3252. The number of times of bending the strand wire greatly increased. In view of this, when an elemental wire having a small dynamic friction coefficient is used for a strand wire, a fatigue characteristic improving effect can be expected. Moreover, as shown in Tables 17 to 19, the Al alloy wires in the softened member sample group each have small surface roughness. Quantitatively, the surface roughness is equal to or less than 3 μm, is equal to or less than 2 μm in many samples, and is equal to or less than 1 μm in some samples. In a comparison between sample No. 1-5 (Table 17, Table 9) and sample No. 1-108 (Table 20, Table 12) having the same composition, a comparison between sample No. 2-5 (Table 18, Table 10) and sample No. 2-208 (Table 20, Table 12) having the same composition, and a comparison between sample No. 3-3 (Table 19, Table 11) and sample No. 3-307 (Table 20, Table 12) having the same composition, the dynamic friction coefficient tends to be smaller, the number of times of bending tends to be larger, and the impact resistance tend to be more excellent in each of samples No. 1-5, No. 2-5, and No. 3-3. In view of this, a small dynamic friction coefficient is considered to contribute to improvement in fatigue characteristics and improvement in impact resistance. Moreover, in order to reduce the dynamic friction coefficient, it can be said that it is effective to attain a small surface roughness.

As shown in Tables 13 to 15, it can be said that, when the lubricant adheres to the surface of each of the Al alloy wires in the softened member sample group, particularly, when the amount of adhesion of C is equal to or more than 1 mass % (see the comparison with sample No. 2-8 in Table 14 and Table 18), the dynamic friction coefficient is more likely to be small as shown in Tables 17 to 19. It can be said that, even when the surface roughness is comparatively large, but when the amount of adhesion of C is large, the dynamic friction coefficient is more likely to be small (for example, see sample No. 3-10 (Tables 15 and 19). Moreover, as shown in Table 21, it turns out that excellent corrosion resistance is achieved since the lubricant adheres to the surface of the Al alloy wire. When the amount of adhesion of the lubricant (amount of adhesion of C) is too large, the resistance of connection to the terminal portion is increased. Thus, it is considered that the amount of adhesion of the lubricant is preferably small to some extent, particularly, equal to or less than 30 mass %.

(2) As shown in Tables 13 to 15, the Al alloy wires in the softened member sample group show relatively small crystal grain sizes. Quantitatively, the average crystal grain size is equal to or less than 50 μm, and in most of the samples, equal to or less than 35 μm, and further, equal to or less than 30 μm, which are smaller than that of sample No. 2-204 (Table 16). When comparing sample No. 2-5 and sample No. 2-204 having the same composition, sample No. 2-5 is greater in evaluation parameter value of impact resistance (Tables 18 and 20) and also larger in number of times of bending (Tables 10 and 12) than sample No. 2-204. Thus, it is considered that a small crystal grain size contributes to improvement in impact resistance and fatigue characteristics. In addition, it can be said based on this test that the crystal grain size is readily reduced by setting the heat treatment temperature to be relatively low or by setting the retention time to be relatively short.

(3) As shown in Tables 17 to 19, the Al alloy wires in the softened member sample group each have a surface oxide film, which is relatively thin (comparatively see sample No. 2-209 in Table 20) and equal to or less than 120 nm. Thus, it is considered that these Al alloy wires can suppress the increase of the resistance of connection to the terminal portion, thereby allowing construction of a low-resistance connection structure. Also, it is considered that the surface oxide film having an appropriate uniform thickness (equal to or more than 1 nm in this case) contributes to improvement in corrosion resistance as mentioned above. In addition, it can be said based on this test that a surface oxide film is more likely to be formed thicker in an air atmosphere for heat treatment such as softening treatment or under the condition allowing formation of a boehmite layer, and also that a surface oxide film is more likely to be formed thinner in a low-oxygen atmosphere.

The Al alloy wire composed of an Al—Fe-based alloy having a specific composition, subjected to softening treatment and having a surface layer including a certain amount of fine crystallized materials as described above has high strength, high toughness and high electrical conductivity, and is also excellent in strength of connection to the terminal portion and excellent in impact resistance and fatigue characteristics. It is expected that such an Al alloy wire can be suitably utilized for a conductor of a covered electrical wire, particularly, a conductor of a terminal-equipped electrical wire to which a terminal portion is attached.

The present invention is defined by the terms of the claims, but not limited to the above description, and is intended to include any modifications within the meaning and scope equivalent to the terms of the claims.

For example, the composition of the alloy, the cross-sectional area of the wire member, the number of wire members stranded into a strand wire, and the manufacturing conditions (the temperature of melt, the cooling rate during casting, the timing of heat treatment, the heat treatment conditions, and the like) in Test Example 1 can be changed as appropriate.

[Clauses]

The following configuration can be employed as an aluminum alloy wire that is excellent in impact resistance and fatigue characteristics. For example, the following can be employed as a method of manufacturing an aluminum alloy wire that is excellent in impact resistance and fatigue characteristics.

[Clause 1]

An aluminum alloy wire is composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a sector-shaped crystallization measurement region of 3750 $\mu m^2$ is defined within an annular surface-layer region extending from a surface of the aluminum alloy wire by 50 μm in a depth direction. An average area of crystallized materials existing in the sector-shaped crystallization measurement region is equal to or greater than 0.05 $\mu m^2$ and equal to or less than 3 $\mu m^2$.

[Clause 2]

In the aluminum alloy wire described in [Clause 1], the number of the crystallized materials existing in the sector-shaped crystallization measurement region is more than 10 and equal to or less than 400.

[Clause 3]

In the aluminum alloy wire described in [Clause 1] or [Clause 2], in the transverse section of the aluminum alloy wire, an inside crystallization measurement region in a shape of a rectangle having a short side length of 50 μm and a long side length of 75 μm is defined such that a center of the rectangle of the inside crystallization measurement region coincides with a center of the aluminum alloy wire, and an average area of crystallized materials in the inside crystallization measurement region is equal to or more than 0.05 $\mu m^2$ and equal to or less than 40 $\mu m^2$.

[Clause 4]

In the aluminum alloy wire described in any one of [Clause 1] to [Clause 3], an average crystal grain size of the aluminum alloy is equal to or less than 50 μm.

[Clause 5]

In the aluminum alloy wire described in any one of [Clause 1] to [Clause 4], in a transverse section of the aluminum alloy wire, a sector-shaped void measurement region of 1500 $\mu m^2$ is defined within an annular surface-layer region extending from a surface of the aluminum alloy wire by 30 μm in a depth direction, and a total cross-sectional area of voids in the sector-shaped void measurement region is equal to or less than 2 $\mu m^2$.

[Clause 6]

In the aluminum alloy wire described in [Clause 5], in the transverse section of the aluminum alloy wire, an inside void measurement region in a shape of a rectangle having a short side length of 30 μm and a long side length of 50 μm is defined such that a center of the rectangle of the inside void measurement region coincides with a center of the aluminum alloy wire, and a ratio of a total cross-sectional area of voids in the inside void measurement region to the total cross-sectional area of the voids in the sector-shaped void measurement region is equal to or more than 1.1 and equal to or less than 44.

[Clause 7]

In the aluminum alloy wire described in [Clause 5] or [Clause 6], a content of hydrogen is equal to or less than 4.0 ml/100 g.

[Clause 8]

In the aluminum alloy wire described in any one of [Clause 1] to [Clause 7], a work hardening exponent is equal to or more than 0.05.

[Clause 9]

In the aluminum alloy wire described in any one of [Clause 1] to [Clause 8], a dynamic friction coefficient is equal to or less than 0.8.

[Clause 10]

In the aluminum alloy wire described in any one of [Clause 1] to [Clause 9], a surface roughness is equal to or less than 3 μm.

[Clause 11]

In the aluminum alloy wire described in any one of [Clause 1] to [Clause 10], a lubricant adheres to a surface of the aluminum alloy wire, and an amount of adhesion of C originated from the lubricant is more than 0 mass % and equal to or less than 30 mass %.

[Clause 12]

In the aluminum alloy wire described in any one of [Clause 1] to [Clause 11], the aluminum alloy wire has a surface oxide film having a thickness of equal to or more than 1 nm and equal to or less than 120 nm.

[Clause 13]

In the aluminum alloy wire described in any one of [Clause 1] to [Clause 12], the aluminum alloy further contains: equal to or more than 0 mass % and equal to or less than 1.0 mass % in total of one or more of elements selected from Mg, Si, Cu, Mn, Ni, Zr, Ag, Cr, and Zn.

[Clause 14]

In the aluminum alloy wire described in any one of [Clause 1] to [Clause 13], the aluminum alloy further contains at least one of elements of: equal to or more than 0 mass % and equal to or less than 0.05 mass % of Ti; and equal to or more than 0 mass % and equal to or less than 0.005 mass % of B.

[Clause 15]

In the aluminum alloy wire described in any one of [Clause 1] to [Clause 14], one or more characteristics selected from the following characteristics are satisfied, including: tensile strength equal to or more than 110 MPa and equal to or less than 200 MPa; 0.2% proof stress equal to or more than 40 MPa; breaking elongation equal to or more than 10%; and electrical conductivity equal to or more than 55% IACS.

[Clause 16]

An aluminum alloy strand wire includes a plurality of the aluminum alloy wires described in any one of [Clause 1] to [Clause 15], the aluminum alloy wires being stranded together.

[Clause 17]

In the aluminum alloy strand wire described in [Clause 16], a strand pitch is equal to or more than 10 times and equal to or less than 40 times as large as a pitch diameter of the aluminum alloy strand wire.

[Clause 18]

A covered electrical wire includes: a conductor; and an insulation cover that covers an outer circumference of the conductor. The conductor includes the aluminum alloy strand wire described in [Clause 16] or [Clause 17].

[Clause 19]

A terminal-equipped electrical wire includes: the covered electrical wire described in [Clause 18]; and a terminal portion attached to an end portion of the covered electrical wire.

[Clause 20]

A method of manufacturing an aluminum alloy wire, comprises:

a casting step of forming a cast material by casting a melt of an aluminum alloy that contains equal to or more than 0.005 mass % and equal to or less than 2.2 mass % of Fe and a remainder of Al and an inevitable impurity;

an intermediate working step of subjecting the cast material to plastic working to form an intermediate work material;

a wire-drawing step of subjecting the intermediate work material to wire drawing to form a wire-drawn member; and a heat treatment step of performing heat treatment during the wire drawing or after the wire-drawing step.

In the casting step, the melt is set at a temperature equal to or higher than a liquidus temperature and less than 750° C., and a cooling rate in a temperature range from a temperature of the melt to 650° C. is set to be equal to or more than 1° C./second and less than 25° C./second.

[Clause 21]

An aluminum alloy wire is composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a sector-shaped void measurement region of 1500 $\mu m^2$ is defined within an annular surface layer region extending from a surface of the aluminum alloy wire by 30 μm in a depth direction, and a total cross-sectional area of voids in the sector-shaped void measurement region is equal to or less than 2 $\mu m^2$.

The aluminum alloy wire described in the above-mentioned [Clause 21] is more excellent in impact resistance and fatigue characteristics when it satisfies at least one of the features described in [Clause] 1 to [Clause 15]. Furthermore, the aluminum alloy wire described in the above-mentioned [Clause 21] can be utilized for the aluminum alloy strand wire, the covered electrical wire, or the terminal-equipped electrical wire, each of which is described in any one of [Clause 16] to [Clause 19].

REFERENCE SIGNS LIST

1 covered electrical wire, 10 terminal-equipped electrical wire, 2 conductor, 20 aluminum alloy strand wire, 22 aluminum alloy wire (elemental wire), 220 surface layer region, 222 surface-layer crystallization measurement region, 224 crystallization measurement region, 22S short side, 22L long side, P contact point, T tangent line, C straight line, g cavity, 3 insulation cover, 4 terminal portion, 40 wire barrel portion, 42 fitting portion, 44 insulation barrel portion, S sample, 100 mount, 110 weight, 150 counterpart material.

The invention claimed is:

1. An aluminum alloy wire composed of an aluminum alloy, wherein the aluminum alloy contains equal to or more than 0.005 mass % and equal to or less than 2.2 mass % of Fe, equal to or more than 0 mass % and equal to or less than 1.0 mass % in total of one or more of elements selected from Mg, Si, Cu, Mn, Ni, Zr, Ag, Cr, and Zn, and a remainder of Al and an inevitable impurity, and in a transverse section of the aluminum alloy wire, a surface-layer crystallization measurement region in a shape of a rectangle having a short side length of 50 μm and a long side length of 75 μm is defined within a surface layer region extending from a surface of the aluminum alloy wire by 50 μm in a depth direction, and an average area of crystallized materials in the surface-layer crystallization measurement region is equal to or more than 0.05 $\mu m^2$ and equal to or less than 3 $\mu m^2$.

2. The aluminum alloy wire according to claim 1, wherein the number of the crystallized materials in the surface-layer crystallization measurement region is more than 10 and equal to or less than 400.

3. The aluminum alloy wire according to claim 1, wherein, in the transverse section of the aluminum alloy wire, an inside crystallization measurement region in a shape of a rectangle having a short side length of 50 μm and a long side length of 75 μm is defined such that a center of the rectangle of the inside crystallization measurement region coincides with a center of the aluminum alloy wire, and an average area of crystallized materials in the inside crystallization measurement region is equal to or more than 0.05 $\mu m^2$ and equal to or less than 40 $\mu m^2$.

4. The aluminum alloy wire according to claim 1, wherein an average crystal grain size of the aluminum alloy is equal to or less than 50 μm.

5. The aluminum alloy wire according to claim 1, wherein, in the transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$.

6. The aluminum alloy wire according to claim 5, wherein, in the transverse section of the aluminum alloy wire, an inside void measurement region in a shape of a rectangle having a short side length of 30 μm and a long side length of 50 μm is defined such that a center of the rectangle of the inside void measurement region coincides with a center of the aluminum alloy wire, and a ratio of a total cross-sectional area of voids in the inside void measurement region to the total cross-sectional area of the voids in the surface-layer void measurement region is equal to or more than 1.1 and equal to or less than 44.

7. The aluminum alloy wire according to claim 5, wherein a content of hydrogen is equal to or less than 4.0 ml/100 g.

8. The aluminum alloy wire according to claim 1, wherein a work hardening exponent is equal to or more than 0.05.

9. The aluminum alloy wire according to claim 1, wherein a dynamic friction coefficient is equal to or less than 0.8.

10. The aluminum alloy wire according to claim 1, wherein a surface roughness is equal to or less than 3 μm.

11. The aluminum alloy wire according to claim 1, wherein a lubricant adheres to a surface of the aluminum alloy wire, and an amount of adhesion of C originated from the lubricant is more than 0 mass % and equal to or less than 30 mass %.

12. The aluminum alloy wire according to claim 1, wherein the aluminum alloy wire has a surface oxide film having a thickness of equal to or more than 1 nm and equal to or less than 120 nm.

13. The aluminum alloy wire according to claim 1, wherein tensile strength is equal to or more than 110 MPa and equal to or less than 200 MPa, 0.2% proof stress is equal to or more than 40 MPa, breaking elongation is equal to or more than 10%, and electrical conductivity is equal to or more than 55% IACS.

14. An aluminum alloy strand wire comprising a plurality of the aluminum alloy wires according to claim 1, the plurality of the aluminum alloy wires being stranded together.

15. The aluminum alloy strand wire according to claim 14, wherein a strand pitch is equal to or more than 10 times and equal to or less than 40 times as large as a pitch diameter of the aluminum alloy strand wire.

16. A covered electrical wire comprising:

a conductor; and an insulation cover that covers an outer circumference of the conductor, wherein the conductor includes the aluminum alloy strand wire according to claim 14.

17. A terminal-equipped electrical wire comprising:

the covered electrical wire according to claim 16; and a terminal portion attached to an end portion of the covered electrical wire.

* * * * *